US010480740B2

(12) United States Patent
Kratochvil et al.

(10) Patent No.: US 10,480,740 B2
(45) Date of Patent: Nov. 19, 2019

(54) LIGHT DEVICE, ESPECIALLY A PROJECTOR SYSTEM OF A HEADLIGHT FOR MOTOR VEHICLES

(71) Applicant: Varroc Lighting Systems, s.r.o., Senov u Noveho Jicina (CZ)

(72) Inventors: Jan Kratochvil, Horka-Domky (CZ); Michaela Duliakova, Ostrava-Belsky Les (CZ); Vladimir Kubena, Bernartice nad Odrou (CZ); Zdenek Mikeska, Borsice u Blatnice (CZ); Kvetoslav Odstrcilik, Holesov (CZ); Radek Orlita, Novy Jicin (CZ)

(73) Assignee: VARROC LIGHTING SYSTEMS, S.R.O. (CZ)

( * ) Notice: Subject to any disclaimer, the term of this patent is extended or adjusted under 35 U.S.C. 154(b) by 54 days.

(21) Appl. No.: 15/877,924

(22) Filed: Jan. 23, 2018

(65) Prior Publication Data

US 2018/0209603 A1 Jul. 26, 2018

(30) Foreign Application Priority Data

Jan. 24, 2017 (CZ) ..... 2017-36

(51) Int. Cl.
*F21V 7/00* (2006.01)
*F21S 41/16* (2018.01)
(Continued)

(52) U.S. Cl.
CPC ..... *F21S 41/16* (2018.01); *F21S 41/25* (2018.01); *F21S 41/285* (2018.01); *F21S 41/32* (2018.01); *F21S 41/675* (2018.01); *F21S 41/40* (2018.01)

(58) Field of Classification Search
CPC ..... F21S 41/16; F21S 41/176; F21S 41/663; F21S 41/255; F21S 41/25; F21S 41/285;
(Continued)

(56) References Cited

U.S. PATENT DOCUMENTS 4,868,721 A 9/1989 Soardo
7,428,353 B1 9/2008 Milanovic et al.
(Continued)

FOREIGN PATENT DOCUMENTS

CZ 20150890 A3 6/2017
DE 19907943 A1 9/2000
(Continued)

OTHER PUBLICATIONS

Search Report from corresponding CZ PV 2017-36 dated Oct. 23, 2017 (3 pages).

*Primary Examiner* — Ali Alavi
(74) *Attorney, Agent, or Firm* — Hovey Williams LLP

(57) ABSTRACT

A light device comprises a laser light source, a primary optical system with at least one diffractive and/or at least one reflective optical element to convert monochromatic coherent light to a collimated beam of coherent light, a MOEMS comprising one or more micro-mirrors to route coherent light and convert it to white light, and a secondary optical system comprising at least one diffractive and/or at least one reflective optical element to direct white light from the light device to create a light pattern on the display surface and/or in specific zones in front of the vehicle. It further comprises an electromagnetic control system connected to the MOEMS and the light source to control changes of rotation angle, oscillation angle and oscillation rate and frequency of one of the micro-mirrors, and to control the light source
(Continued)

activity, for controlled changing of the shape and/or position of the light pattern depending on current conditions of the vehicle.

20 Claims, 27 Drawing Sheets

(51) Int. Cl.
*F21S 41/675* (2018.01)
*F21S 41/25* (2018.01)
*F21S 41/20* (2018.01)
*F21S 41/32* (2018.01)
*F21S 41/40* (2018.01)

(58) Field of Classification Search
CPC ... F21S 41/675; F21S 41/32; F21W 2102/145
See application file for complete search history.

(56) References Cited

U.S. PATENT DOCUMENTS

| | | | | |
|---|---|---|---|---|
| 8,502,695 | B2 | 8/2013 | Kishimoto | |
| 2004/0227984 | A1 | 11/2004 | Yamabana et al. | |
| 2009/0046474 | A1* | 2/2009 | Sato | B60Q 1/076 362/466 |
| 2011/0280032 | A1 | 11/2011 | Kishimoto | |
| 2013/0058114 | A1 | 3/2013 | Reiners | |
| 2013/0250381 | A1* | 9/2013 | Toko | G02B 5/32 359/19 |
| 2013/0271947 | A1* | 10/2013 | Finsterbusch | G03B 21/204 362/19 |
| 2014/0307457 | A1 | 10/2014 | Chen | |
| 2015/0029409 | A1* | 1/2015 | Chen | F21S 41/16 349/5 |
| 2015/0043233 | A1 | 2/2015 | Bauer et al. | |
| 2015/0369437 | A1 | 12/2015 | Reinprecht et al. | |
| 2015/0369440 | A1 | 12/2015 | Reinprecht et al. | |
| 2017/0167688 | A1 | 6/2017 | Gloss et al. | |

FOREIGN PATENT DOCUMENTS

| | | | |
|---|---|---|---|
| DE | 102008022795 | A1 | 11/2009 |
| DE | 102011080559 | A1 | 2/2013 |
| EP | 2063170 | A2 | 5/2009 |
| EP | 2581648 | A1 | 4/2013 |
| EP | 2821692 | A1 | 1/2015 |
| EP | 2990264 | A2 | 3/2016 |
| EP | 2954256 | B1 | 7/2016 |
| EP | 3086022 | A1 | 10/2016 |
| EP | 3139082 | A1 | 3/2017 |
| WO | 2012076296 | A3 | 6/2012 |
| WO | 2014072227 | A1 | 5/2014 |
| WO | 2014121315 | A1 | 8/2014 |
| WO | 2015049048 | A1 | 4/2015 |
| WO | 2015140001 | A1 | 9/2015 |

* cited by examiner

LIGHT DEVICE, ESPECIALLY A PROJECTOR SYSTEM OF A HEADLIGHT FOR MOTOR VEHICLES

FIELD OF THE INVENTION

The invention falls within the field of non-portable lighting devices, adapted specially for motor vehicles, and it relates to a projector system for headlights of motor vehicles that is designed to finish the required output characteristic of the light trace in specific zones in front of the driver on the carriageway.

BACKGROUND INFORMATION

A headlight, especially for motor vehicles, contains at least one optical system comprising a powerful light source and optical elements. The light source emits light rays and the optical elements represent a system of refractive and reflective surfaces, interfaces of optical environments and diaphragms that influence the direction of light rays within the creation of the output light trace.

In modern headlights, projector systems are frequently used comprising light units adapted to amplify light by stimulated emission of radiation, called laser units. A laser is used in headlights as an optical source of electromagnetic radiation in the form of light-emitting diodes. Diodes use the principle of electroluminescence, when after the introduction of electric voltage, electric energy is transformed into light in the place of P-N transition. This light is emitted from the laser diode as coherent and monochromatic. Light emitted by laser diodes most frequently has the blue color so to be used in car headlights, light rays pass through a converter, generally in the form of yellow phosphorus, e.g. Cr:YAG, which turns blue light to white light.

Thus, laser diodes may be used, unlike common LED's, in applications where a sharply directional light beam needs to be created. Light devices are known from the documents US20110280032A1, WO2015140001A1, US20150043233A1, and WO2014121315A1, wherein laser diodes make it possible to exactly focus light rays in a particular direction and to hit even a very distant point, which is used to ensure the high-beam light function in headlights of motor vehicles. In accordance with valid regulations, light may be emitted up to the distance of 600 m in front of the vehicle. Thanks to up to 80% higher efficiency of optical systems designed for laser sources, a higher performance of headlights can be achieved. Luminance of a laser source can be up to 100 times higher, while optical systems comprising a laser diode feature 50% lower energy consumption compared to conventional LED's. A disadvantage of most current laser optical concepts is the fact that the benefits of laser diodes are generally used for the high beam function where a high-intensity light trace needs to be provided, the above mentioned laser systems not being adapted for changes of the light characteristic of the output light beam depending on the conditions where the vehicle is found, e.g. no dazzling of the oncoming driver, width of the light beam based on the vehicle speed, the emission direction of the light beam based on the steering wheel position, etc.

Another disadvantage of laser as well as LED optical concepts is the fact that excessive light intensity may harm vision, and the headlights of vehicles must be fitted with safety elements to avoid exceeding of safety limits, especially in case of damage of converter substances or the entire laser diodes. Safety elements for laser beam emission are described e.g. in the documents WO2014072227A1, EP2821692A1, WO2015049048A1, WO2012076296A3, and U.S. Pat. No. 8,502,695B2.

A solution is known from the document EP2954256B1, wherein the light characteristic of the output light beam is ensured by at least two laser diodes when individual modulated laser rays are directed to a light converter by means of turning of a micro-mirror. A disadvantage of this solution is the fact that the projected light image consists of several segments, a laser diode being associated with each segment, which makes the optical concept relatively costly and optically inefficient.

From the prior art, diffraction dividers of the laser beam are known that consist of a binary grating that is designed in such a way to divide coherent light emitted from the laser diode to a particular number of light streams. From the documents US20140307457 and CZ20150890, lamps are known where the light emitted by one laser diode is divided by a divider to a higher number of partial rays. The divider works as a router of photons to direct photons to a predefined space. A disadvantage of the prior art is the fact that optical systems comprising a laser beam divider are intended for signal functions, and are not adapted to create the required output characteristics for lighting of the carriageway in front of the driver. Another disadvantage is the fact that the micro-mirror only turns around one axis, which means that the resulting image can only be influenced in one direction and thus only a light stripe can be produced by each laser diode.

A solution is known from the document U.S. Pat. No. 4,868,721 that contains an assembly of rotary/oscillating micro-mirrors that makes it possible to influence the resulting image in two directions. Between the laser diode and the mirror, a light modulator is situated making it possible to influence the light characteristics of the laser beams of rays, or to even entirely interrupt the laser beam of rays. A disadvantage of this design is the fact that the modulator influences the light beam before it hits the micro-mirror, which means that the light characteristic of the light beam after the reflection from the micro-mirror cannot be influenced.

The document US20130058114 discloses a design wherein light rays reflected by an array of micro-mirrors are directed through an optical assembly comprising diffraction elements in the form of lenses and prisms, which makes it possible to produce a light image consisting of a few segments of different shapes, while different light characteristics can be achieved in each segment. A disadvantage of this design is the fact that an asymmetrically composed light image cannot be created and the light characteristic of the output light trace cannot be dynamically influenced, e.g. an unlit part inside one segment of the resulting light image cannot be created.

More laser optical systems are known from the documents DE19907943, EP2063170, DE102008022795, DE102011080559A1, and EP2990264, that are equipped with micro-mirrors or with opto-electro-mechanical systems called MOEMS. Opto-electro-mechanical elements generally consist of an array of small mirrors that nowadays enable, on the micrometer level, direct control, routing and shaping of light before the light falls onto the converter of the laser beam of rays. A disadvantage of existing laser concepts is the fact that rotation/oscillation of micro-mirrors is carried out in a resonance manner when the micro-mirror oscillates at the same frequency and amplitude, and if the shape of the output light image needs to be influenced, the laser source of light must be switched off. It is not possible to stop a micro-mirror in a certain position or offset/shift the rotation/oscillation axis either. The speed of the micro-mirror is variable because when the rotation direction is changed, the micro-mirror speed is reduced. This results in uneven distribution of the intensity of light. To achieve even distribution of the intensity of light, the laser ray or the beam of laser rays must be switched off, switched on or modulated at a certain time.

The documents US2004227984 and U.S. Pat. No. 7,428,353 disclose technical designs of MOEMS controlling the micro-mirror rotation/tilt angle, the micro-mirror oscillation range/angle, oscillation rate and frequency through electric or electromagnetic control signals, while micro-mirror oscillation can be implemented in two mutually independent directions.

The object of the present invention is to remedy the above-mentioned drawbacks of the prior art and to enable dynamic changing of the light characteristics of the output light beam of a light device, especially the projector system of a headlight for motor vehicles equipped with a laser diode, depending on the conditions where the vehicle is found. The output light trace must comprise at least one light pattern, while the light characteristics of individual patterns must be created from one laser diode in such a way that it is switched off to a minimal extent. The entire optical system must be optically efficient with low production demands.

SUMMARY OF THE INVENTION

The above mentioned objects of the invention are fulfilled by a light device, especially the projector system of a headlight for motor vehicles comprising a laser light source, a primary optical system with at least one diffractive optical element and/or with at least one reflective optical element to convert the monochromatic coherent light produced by the laser light source to a collimated beam of coherent light, a MOEMS comprising one or more micro-mirrors to route coherent light to a converter to convert it to white light, and a secondary optical system comprising at least one diffractive optical element and/or at least one reflective optical element to direct the white light further out of the light device and to create a light pattern on the display surface and/or in specific zones in front of the driver on the carriageway. The light device comprises an electromagnetic control system connected to the MOEMS and to the laser light source to control, through transmission or electric or electromagnetic signals, changes of the rotation angle, changes of the oscillation angle and changes of the oscillation rate and frequency of the free end of at least one of the micro-mirrors, and to control the activity of the laser light source, for controlled changing of the shape and/or position of the light pattern depending on the current conditions where the vehicle finds itself during its operation.

In one of the embodiments, the light device comprises just one laser light source.

In another one of the embodiments, the light device comprises a modulator situated between the laser light source and the secondary optical system along the route of the beam of light rays produced by the laser light source, and advancing from this source to the secondary optical system to influence the light characteristic of this beam or its part.

The modulator can be situated between the laser light source and the primary optical system to influence the light characteristic of the laser beam of coherent light or its part.

Another option of situating the modulator is its positioning between the primary optical system and the secondary optical system to influence the light characteristic of the collimated light beam or its part.

In another one of the embodiments, the primary optical system further comprises a divider to divide the collimated beam into more separate light streams. In such a case, the primary optical system can advantageously comprise a light stream modulator.

In another one of the embodiments, the modulator is configured to interrupt or deflect the beam of light rays or its part, especially the light stream, to produce one or more unlit areas in the light pattern.

The modulator can be connected to an electromagnetic control system that controls the operation of the modulator, especially with respect to the current conditions where the vehicle finds itself during its operation.

In one of the embodiments, the said at least one of the micro-mirrors is arranged in a movable way so that it can be rotated in a controlled manner around the first axis, which is identical with the axis around which the micro-mirror can be oscillated in a controlled way.

In addition, the said at least one of the micro-mirrors can be arranged in a movable way so that it can be rotated in a controlled manner around the second axis, around which the micro-mirror can be oscillated in a controlled manner as well.

In one of the embodiments, the second axis lies on a horizontal plane and is perpendicular to the first axis.

In one of the embodiments, the said at least one of the micro-mirrors is mounted in a movable first carrying frame with the possibility of controlled rotation and oscillation of the micro-mirror in this first frame around the first axis, this first frame being arranged in such a way that it can be rotated and oscillated around the second axis in a controlled way. The first carrying frame is preferably mounted in a movable way in the static second carrying frame.

In one of the embodiments, the electromagnetic control system is connectable to the output of one or more information means in the form of signals, which data collected by the information means about the current conditions where the vehicle finds itself during its operation have been transformed into.

The information means can be the means used to establish the instantaneous angle, turning direction of the vehicle, its instantaneous speed, or to detect an oncoming vehicle.

In another, the converter comprises a self-contained converter layer and a filter that are in mutual direct contact.

The self-contained converter layer can comprise a monocrystal or ceramic body, especially containing Cr:YAG.

In the transmission arrangement, the filter can be located in such a way that coherent light that has been directed by one or more micro-mirrors enters the converter through it.

In the reflective arrangement, the filter can be situated between the cooler and the self-contained converter layer in such a way that coherent light that has been directed by one or more micro-mirrors enters the converter through it. The filter can be connected to the cooler by means of a bonding material, especially by melting.

DESCRIPTION OF THE DRAWINGS

The invention will be clarified in a more detailed way with the use of its embodiment examples with references to attached drawings, where.

EXAMPLES OF EMBODIMENTS OF THE INVENTION

Figure 1A:
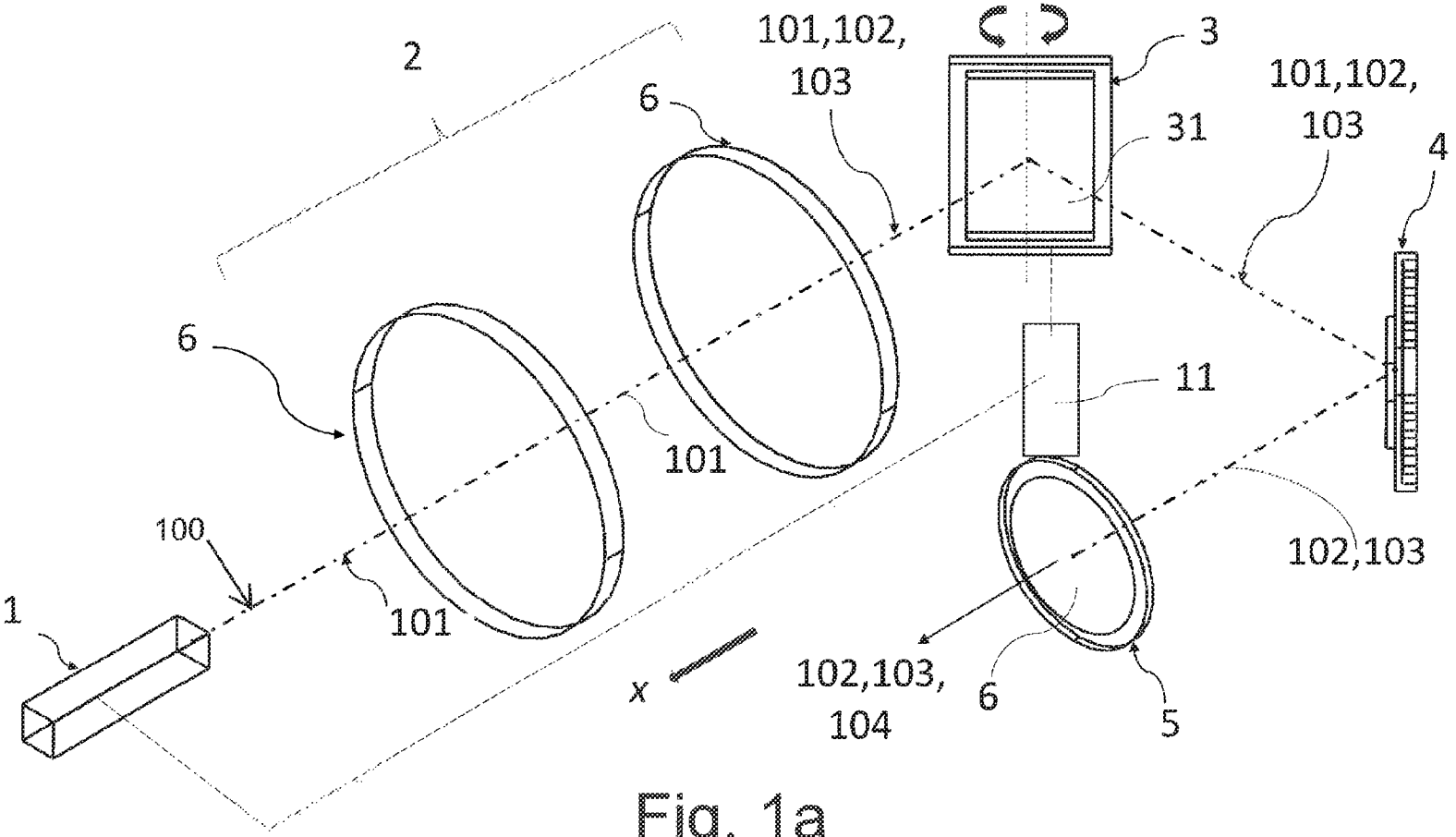
FIG. 1*a* shows a schematic representation of the light device according to the invention.

FIG. 1*a* shows a light device, especially a headlight for motor vehicles comprising a laser light source 1 that comprises only one laser diode to produce coherent light 101, and the primary optical system 2 adapted by means of diffractive optical elements 6 to generate a collimated beam 102 of light rays 100 of coherent light 101 and at the same time to create at least one light stream 103 directed to the MOEMS 3. MOEMS 3 represents a micro-opto-electro-mechanical system adapted by means of the electromagnetic control system 11 to control the micro-mirror 31 and to direct the light stream 103 of coherent light 101 towards the converter 4 to convert the coherent light 101 to white light 104. In the propagation direction of the white light 104, the secondary optical system 5 is situated comprising a diffractive optical element 6 to route the light stream 103 further out of the light device in the direction of the optical axis x.

Figure 1B:
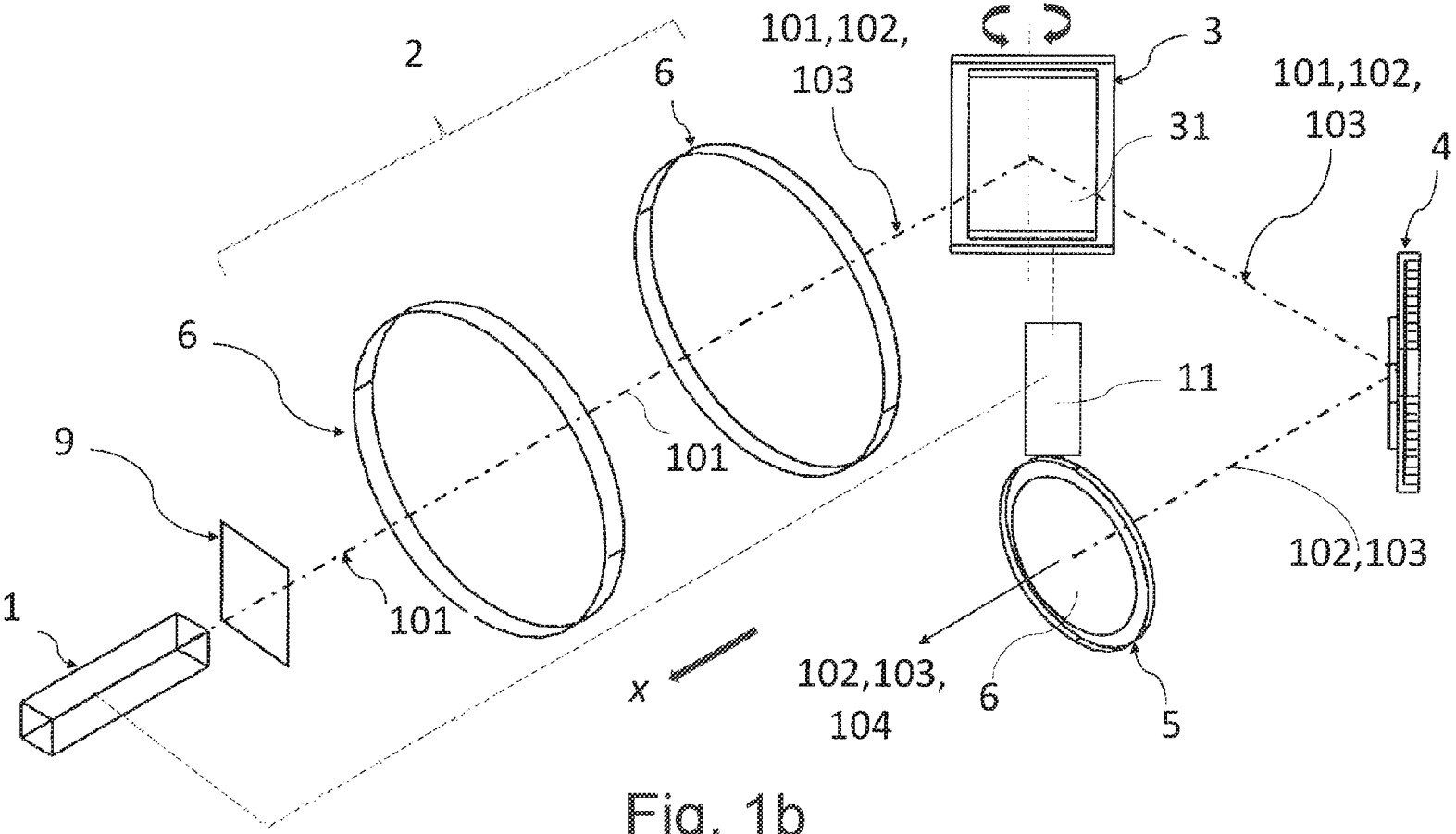
FIGS. 1*b* to 1*e* show more embodiment examples of the light device.

FIG. 1*b* shows an embodiment of the light device comprising a modulator 9 of coherent light 101 to influence the light characteristic of the laser beam of light rays 100.

Figure 1C:
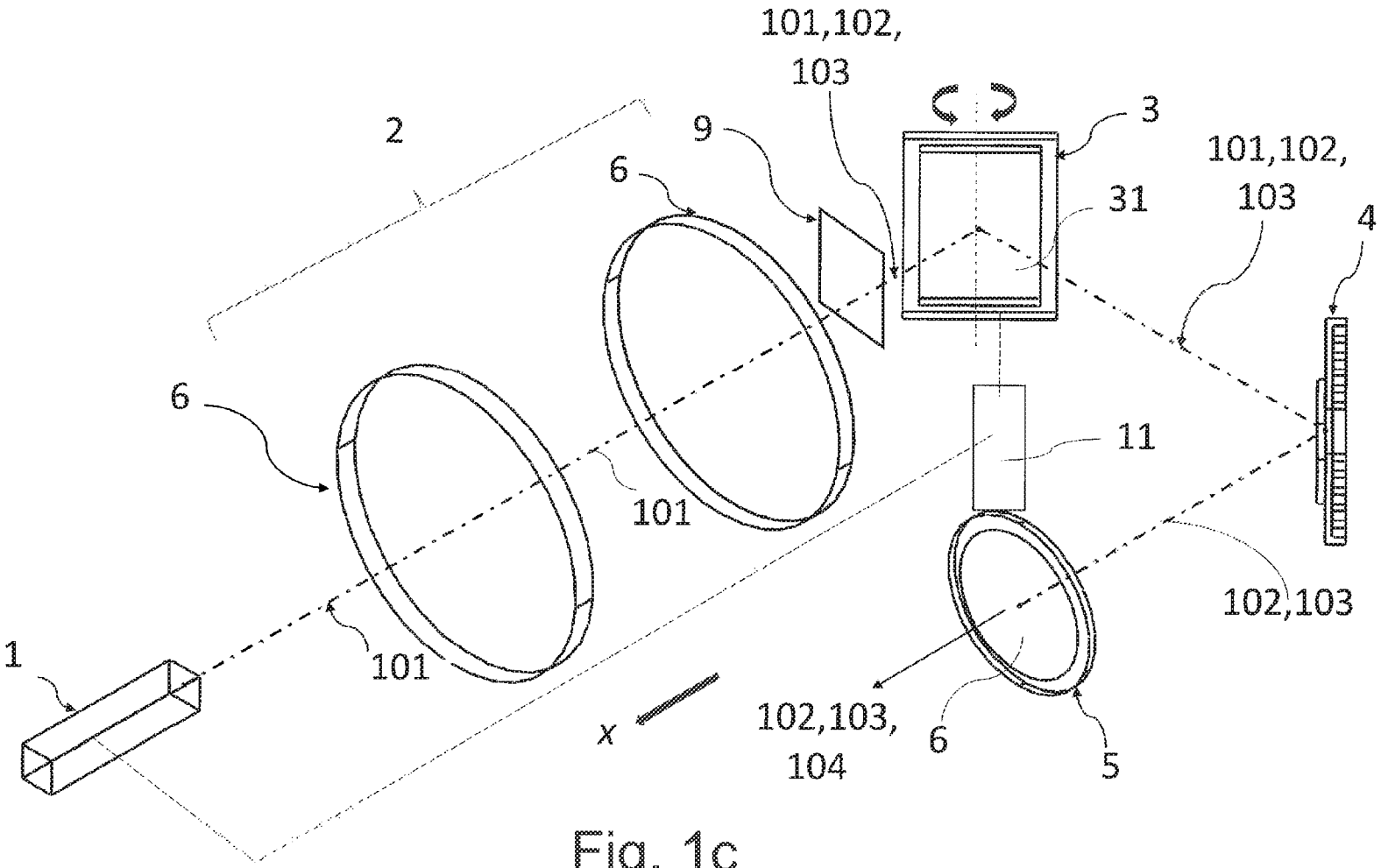
Figure 1D:
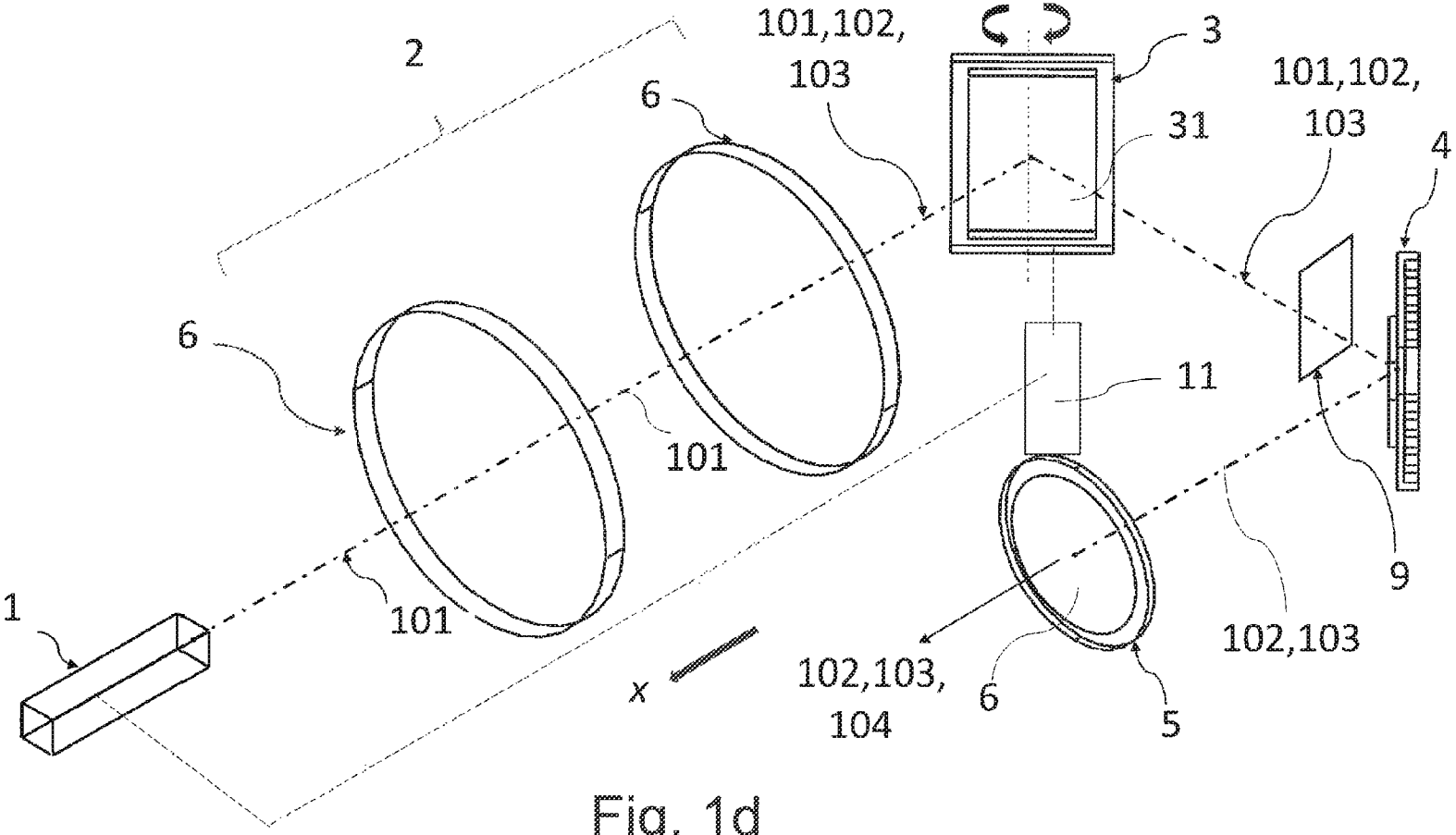

FIGS. 1*c* and 1*d* show an embodiment of the light device comprising a modulator 9 of the collimated light beam 102 of coherent light 101 of at least one light stream 103.

Figure 1E:
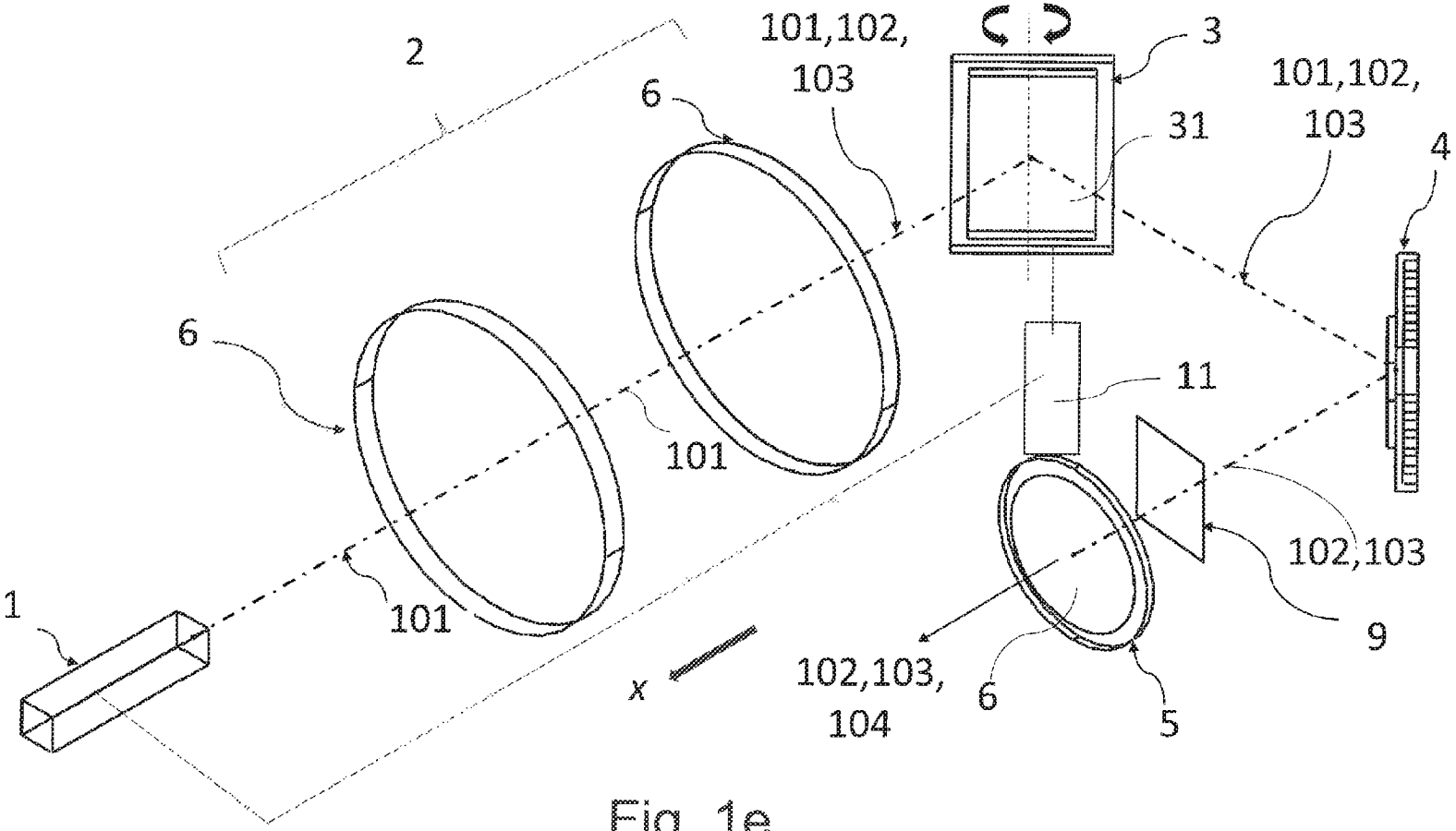

FIG. 1*e* shows an embodiment of the light device comprising a modulator 9 of the controlled light stream 103 of coherent light 101 exiting from the MOEMS 3.

Figure 2A:
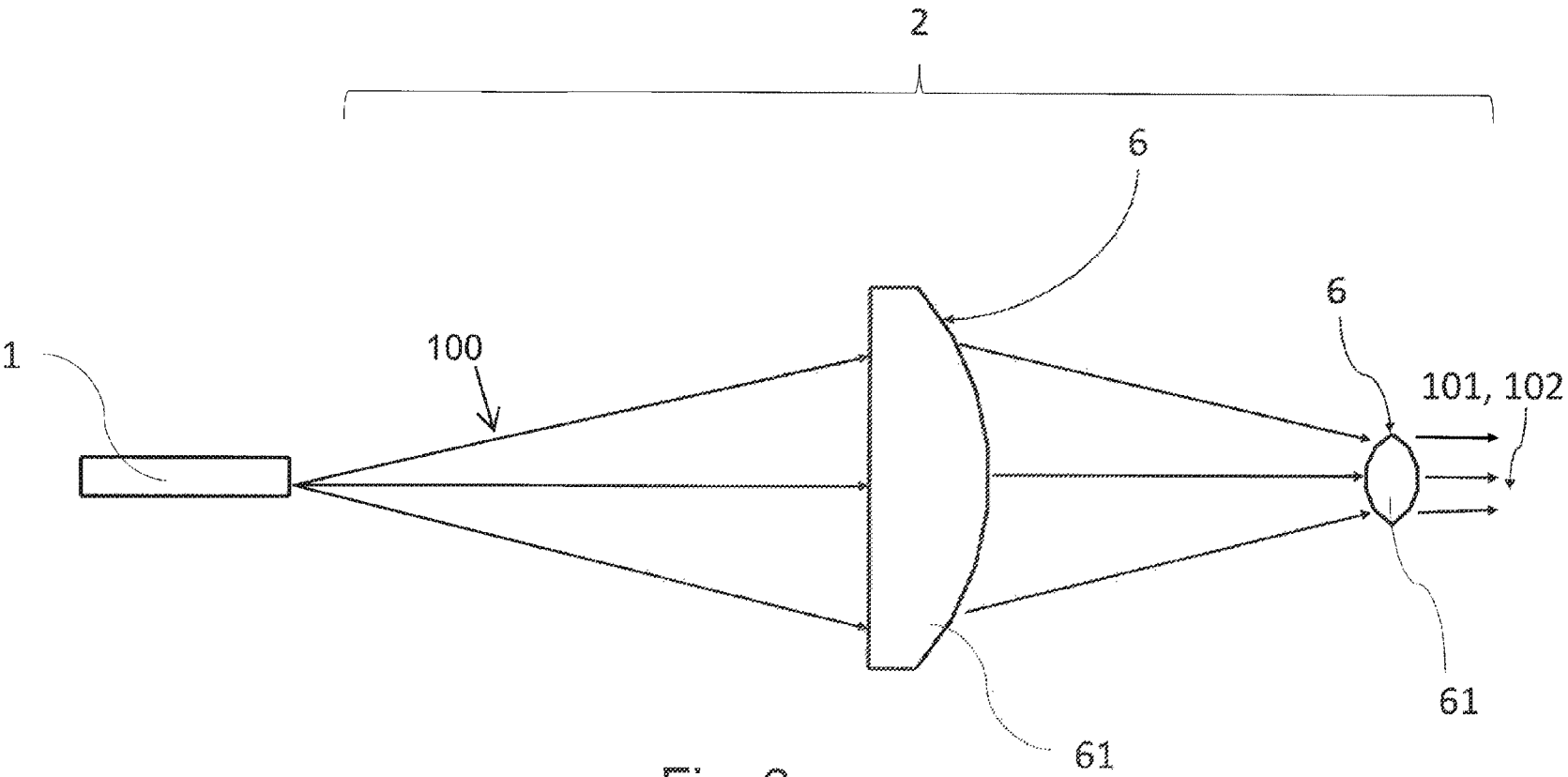
FIGS. 2*a* to 2*e* show embodiment examples of the primary optical system.
Figure 2B:
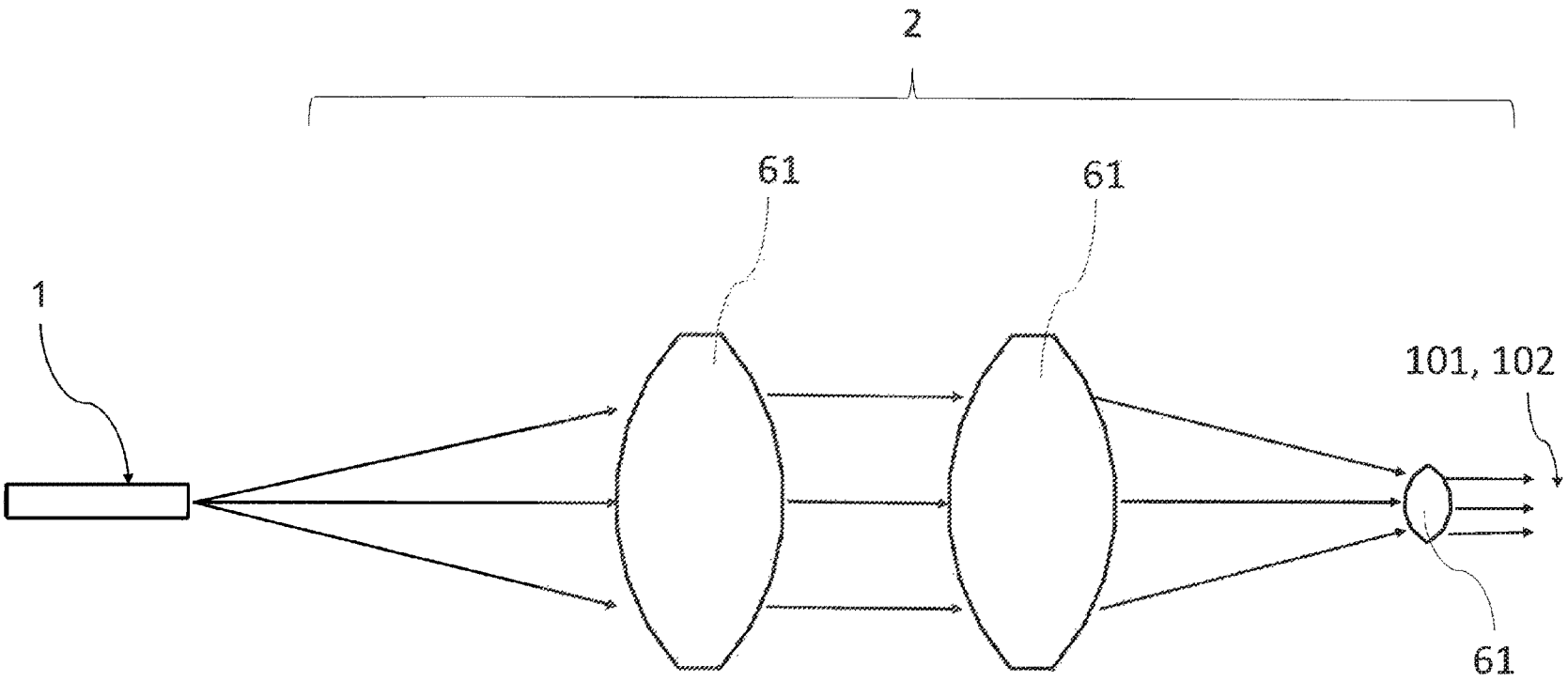
Figure 2C:
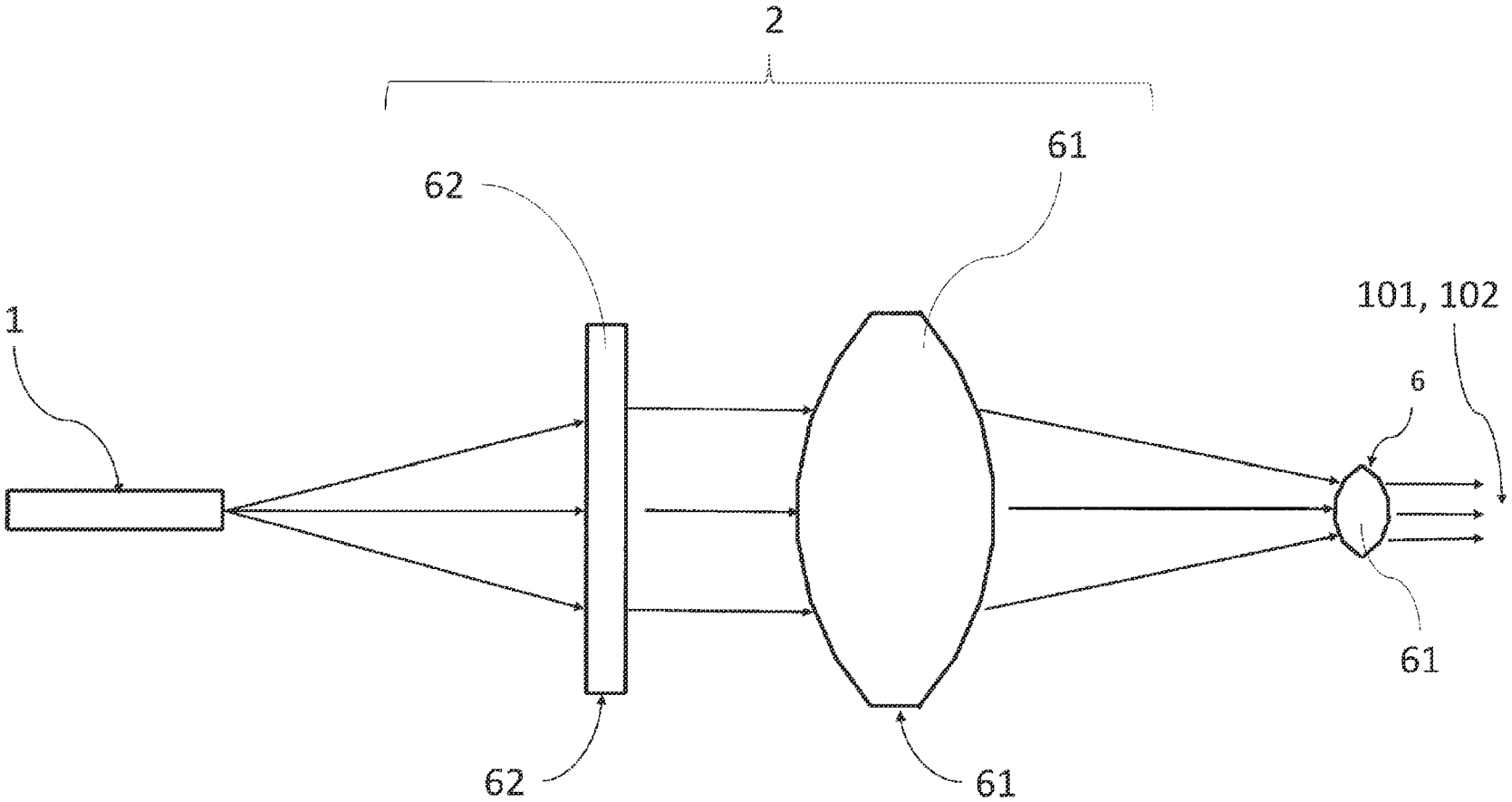
Figure 2D:
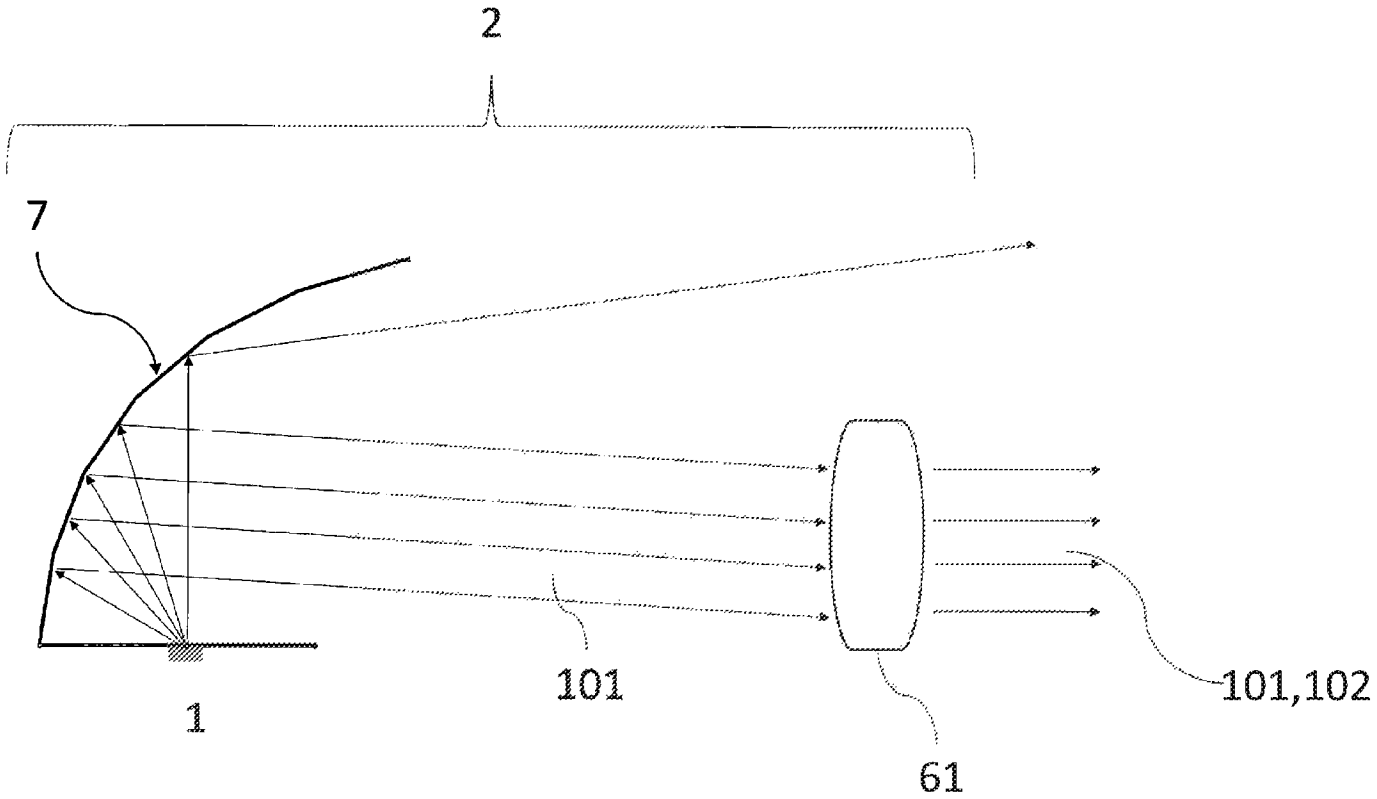
Figure 2E:
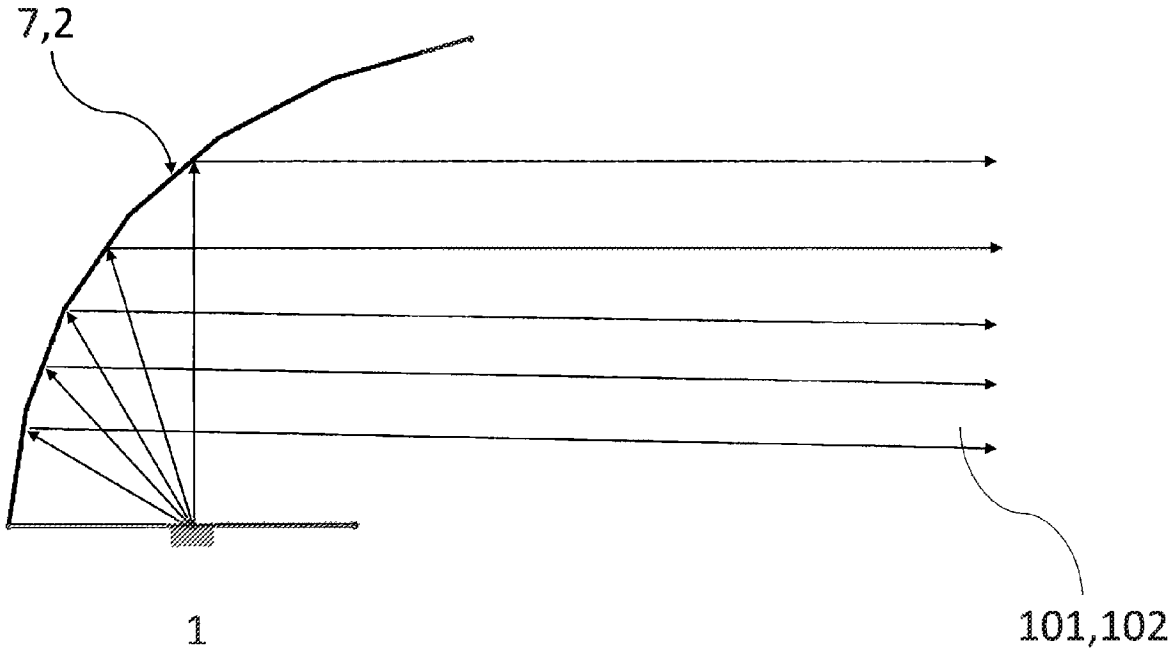

FIG. 2*a* and FIG. 2*b* show the primary optical system 2 comprising diffractive optical elements 6 comprising an array of lenses 61. FIG. 2*c* shows the primary optical system 2 comprising diffractive optical elements 6 in the form of lenses 61 and prisms 62. FIG. 2*d* shows the primary optical system 2 comprising a diffractive optical element 6 in the form of a lens 61 on the one hand, and a reflective optical element 7, e.g. reflector, to direct the collimated beam 102 towards the electromagnetically controlled MOEMS 3, on the other hand. FIG. 2*e* shows the primary optical system 2 comprising only the reflective optical element 7 to create a collimated beam 102 directed towards the electromagnetically controlled MOEMS 3.

According to FIGS. 3*a* to 3*e*, the primary optical system 2 comprises a divider 8 adapted to divide the collimated light beam 102 of coherent light 101 into more separate light streams 103. In another embodiment, shown in FIG. 3*b*, the primary optical system 2 further comprises modulators 9 of the light streams 103, making it possible to influence the light characteristics of the laser beams of rays 100, or to even completely interrupt the light stream 103 or its part, or to deflect it outside the electromagnetically controlled MOEMS 3.

Figure 3A:
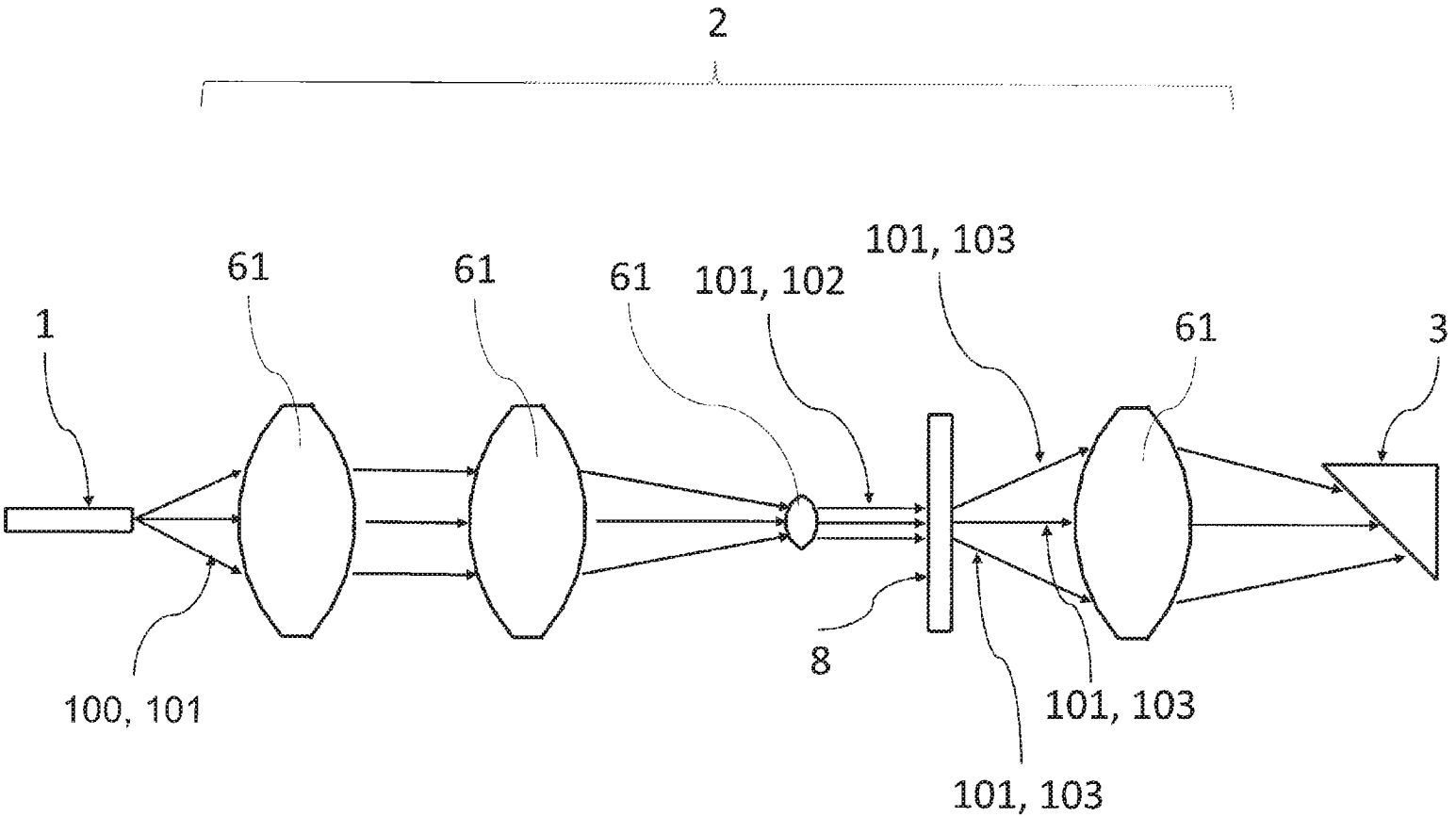
FIGS. 3*a* to 3*g* show more embodiment examples of the primary optical system.
Figure 3B:
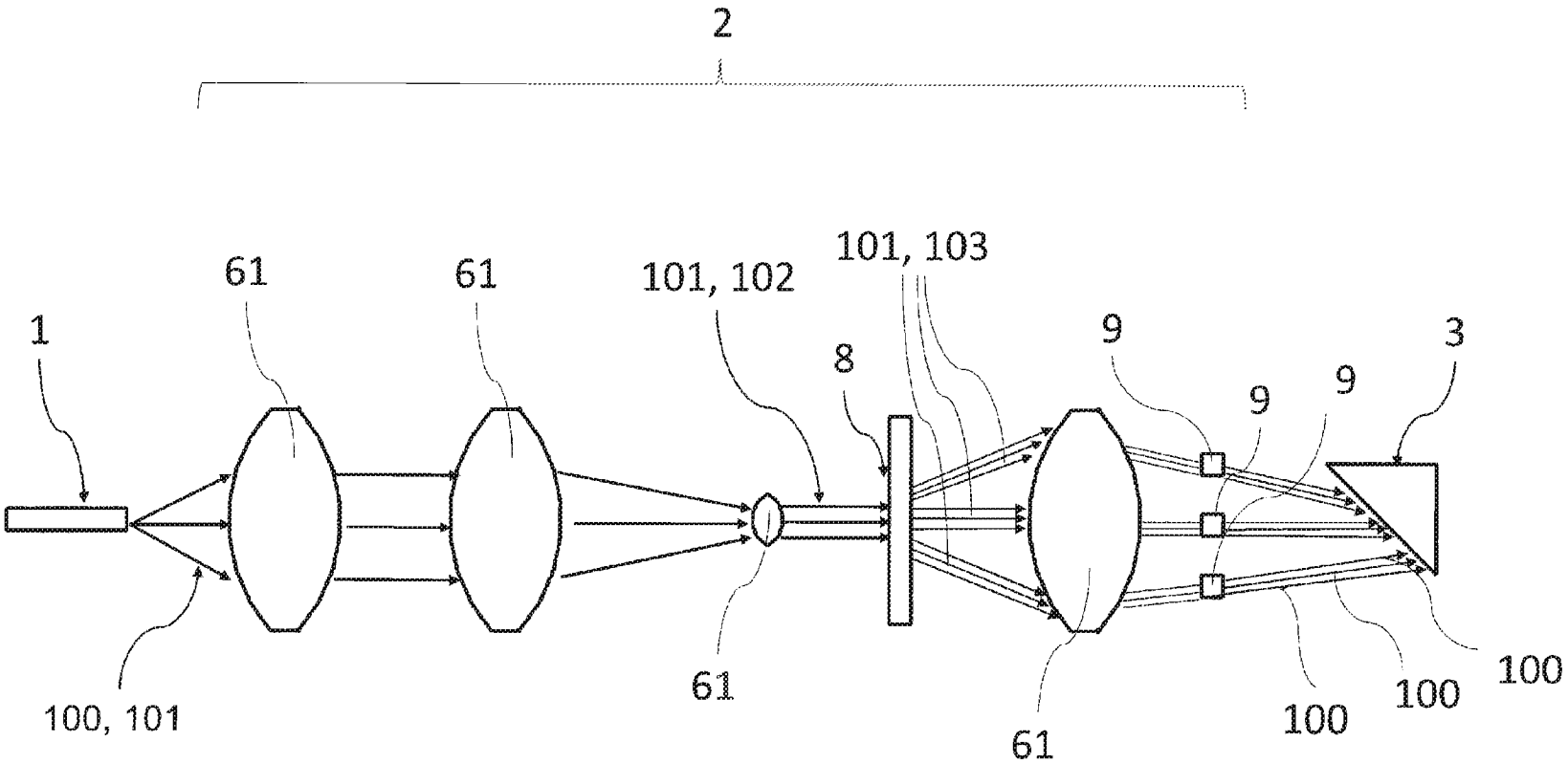
Figure 3C:
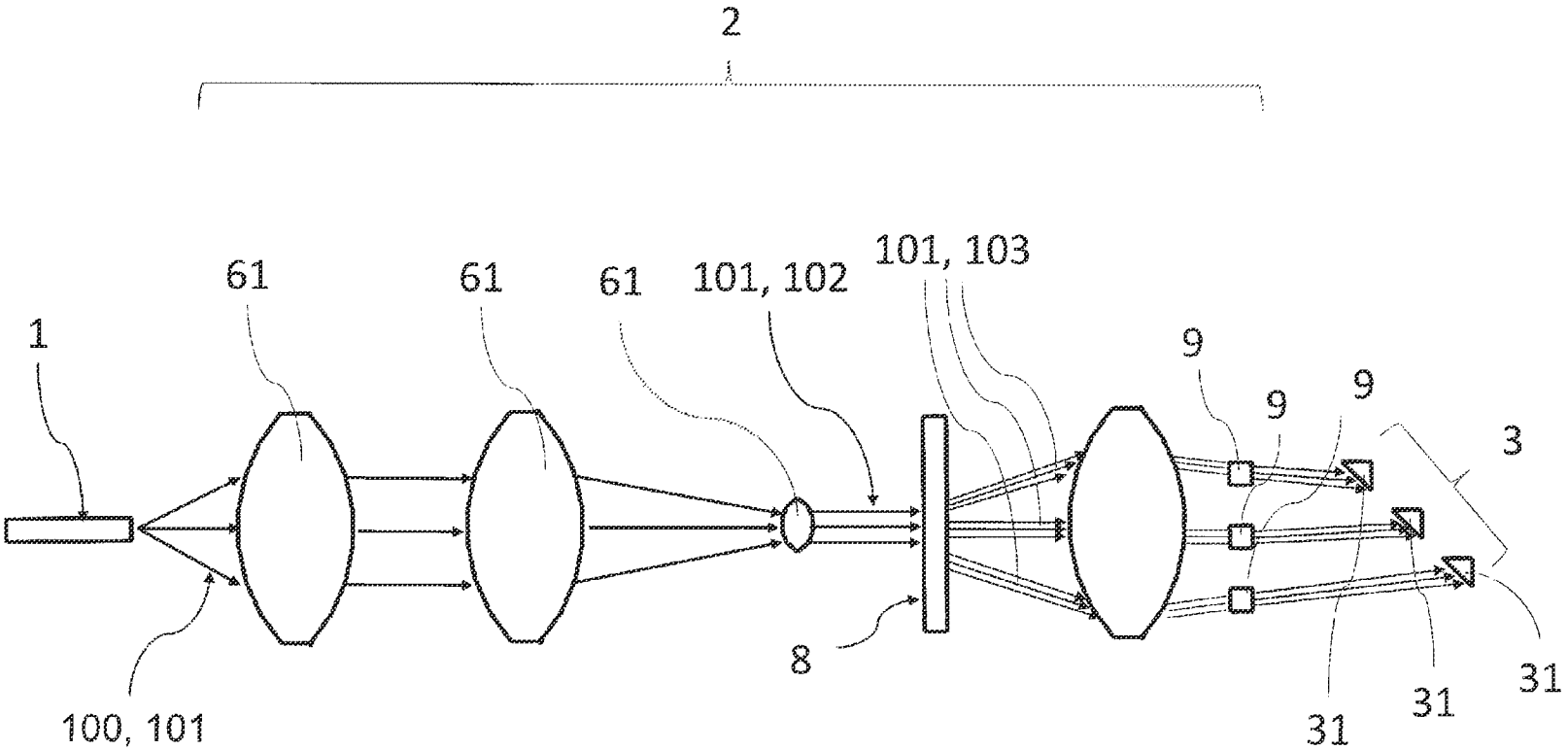
Figure 3D:
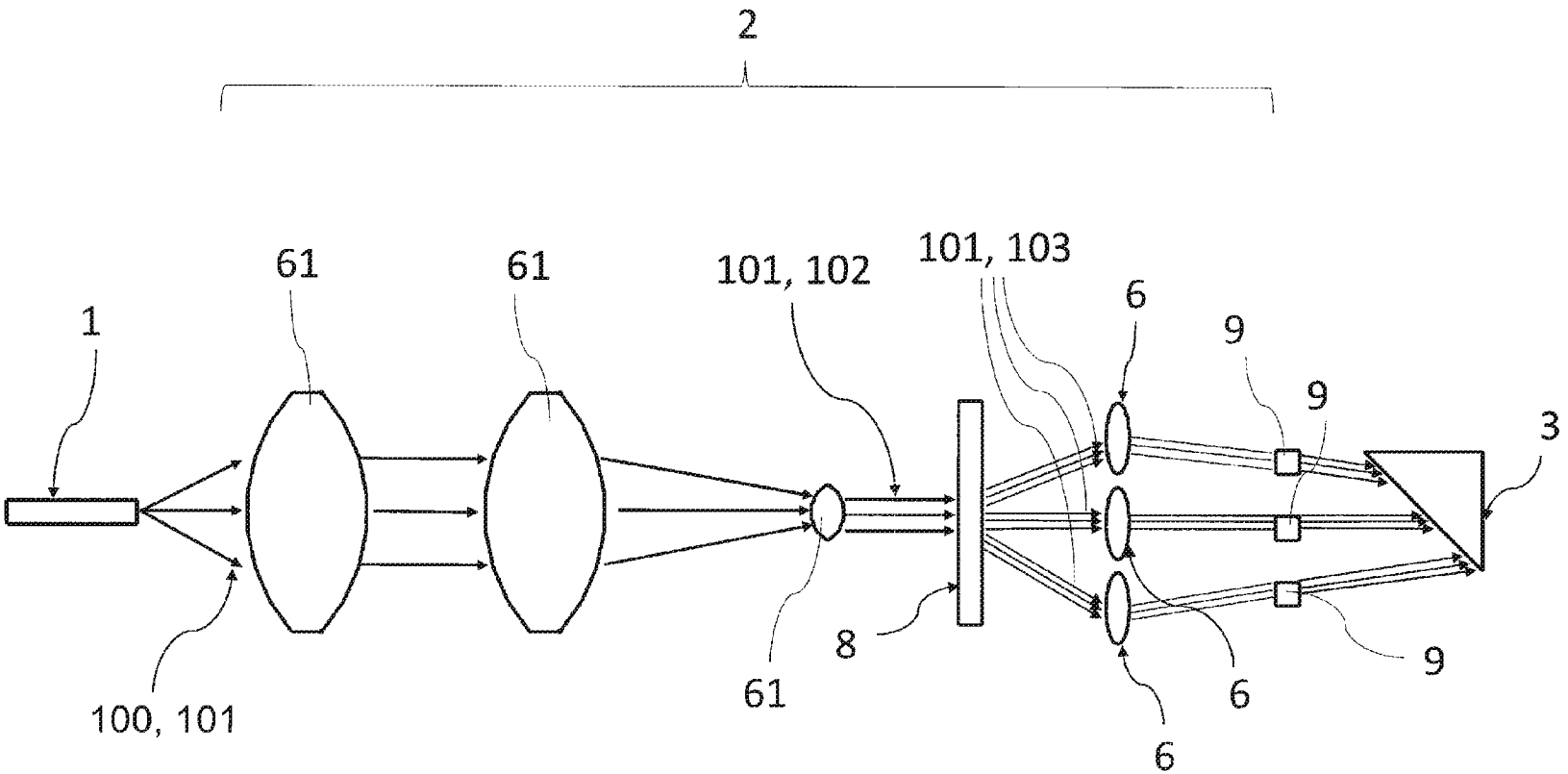
Figure 3E:
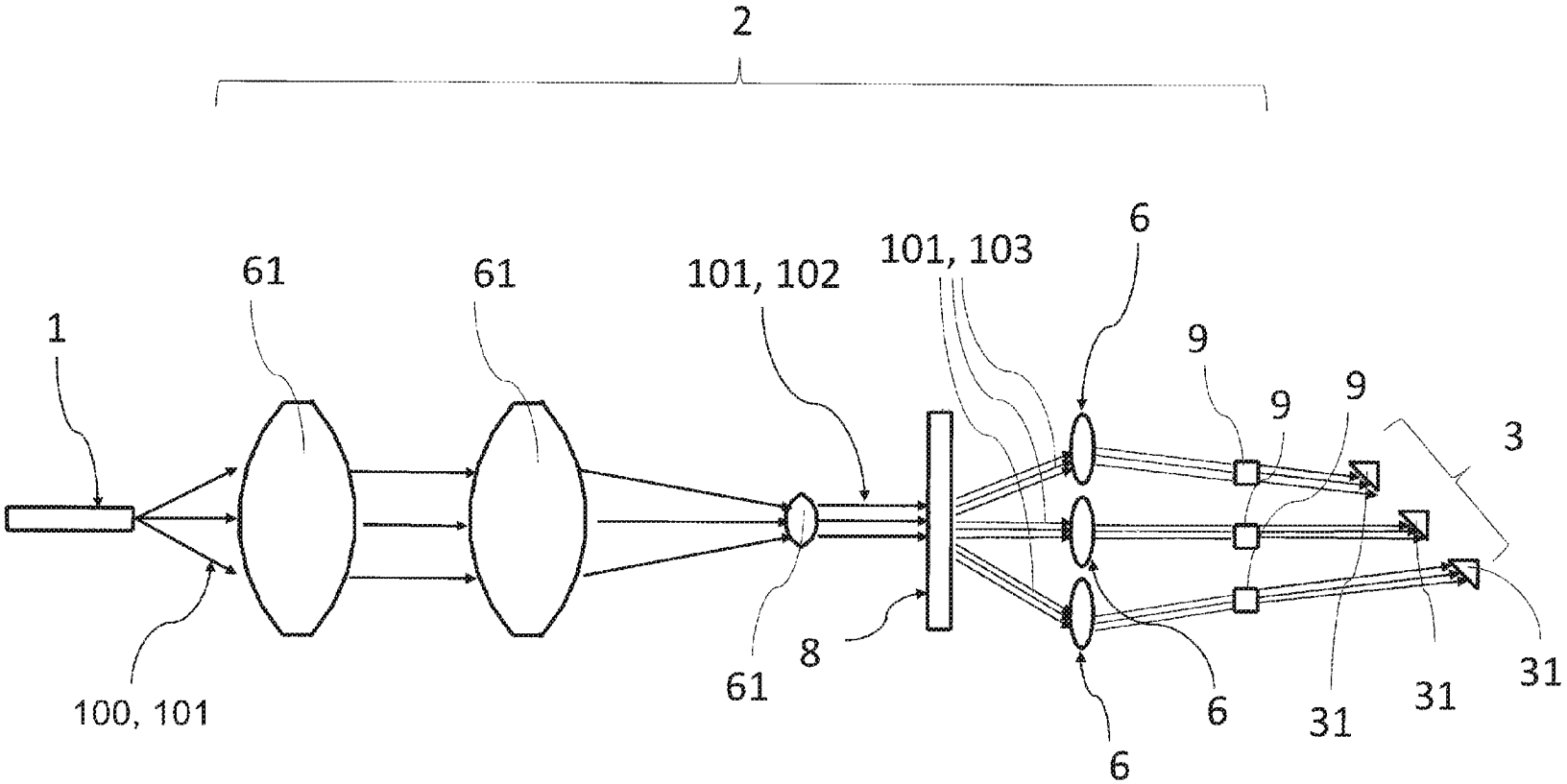

According to FIG. 3*c* and FIG. 3*e*, the electromagnetically controlled MOEMS 3 comprises a micro-mirror 31 for each light stream 103 of coherent light 101. In the embodiments shown in FIG. 3*d* and FIG. 3*e*, the primary optical system 2 comprises for each light stream 103 of coherent light 101 a separate diffractive optical element 6.

Figure 3F:
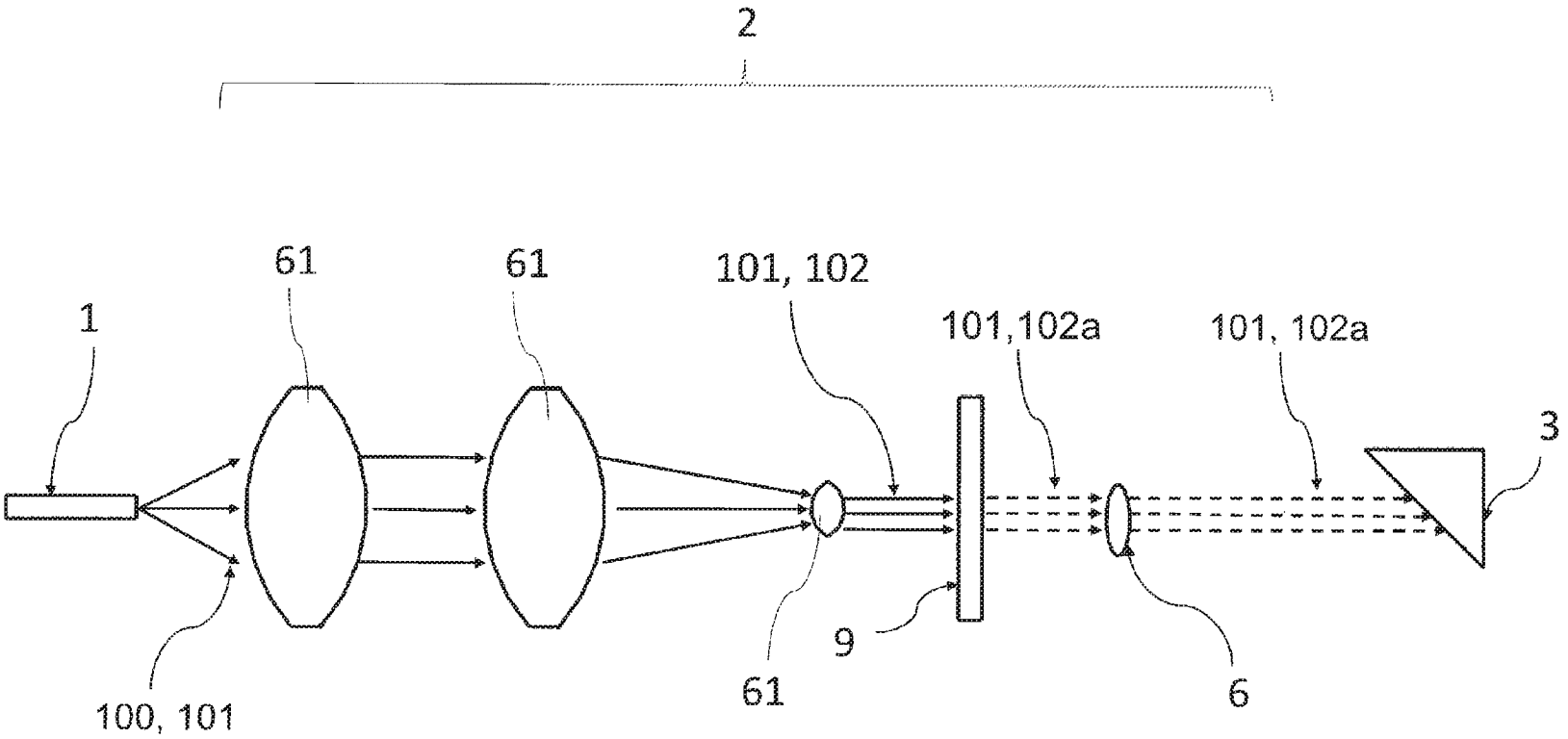

According to FIG. 3*f*, the primary optical system 2 comprises an electro-optical modulator 9 of the light beam 102 of coherent light 101 to produce an electro-optically modulated light beam 102*a*. The modulation is accomplished by influencing the amplitude, polarity or phase of the entire input light beam 102 or its part e.g. in the form of an LCD display or by means of devices used for amplitude, phase and polarizing modulation of light waves (PLM, SLM).

Figure 3G:
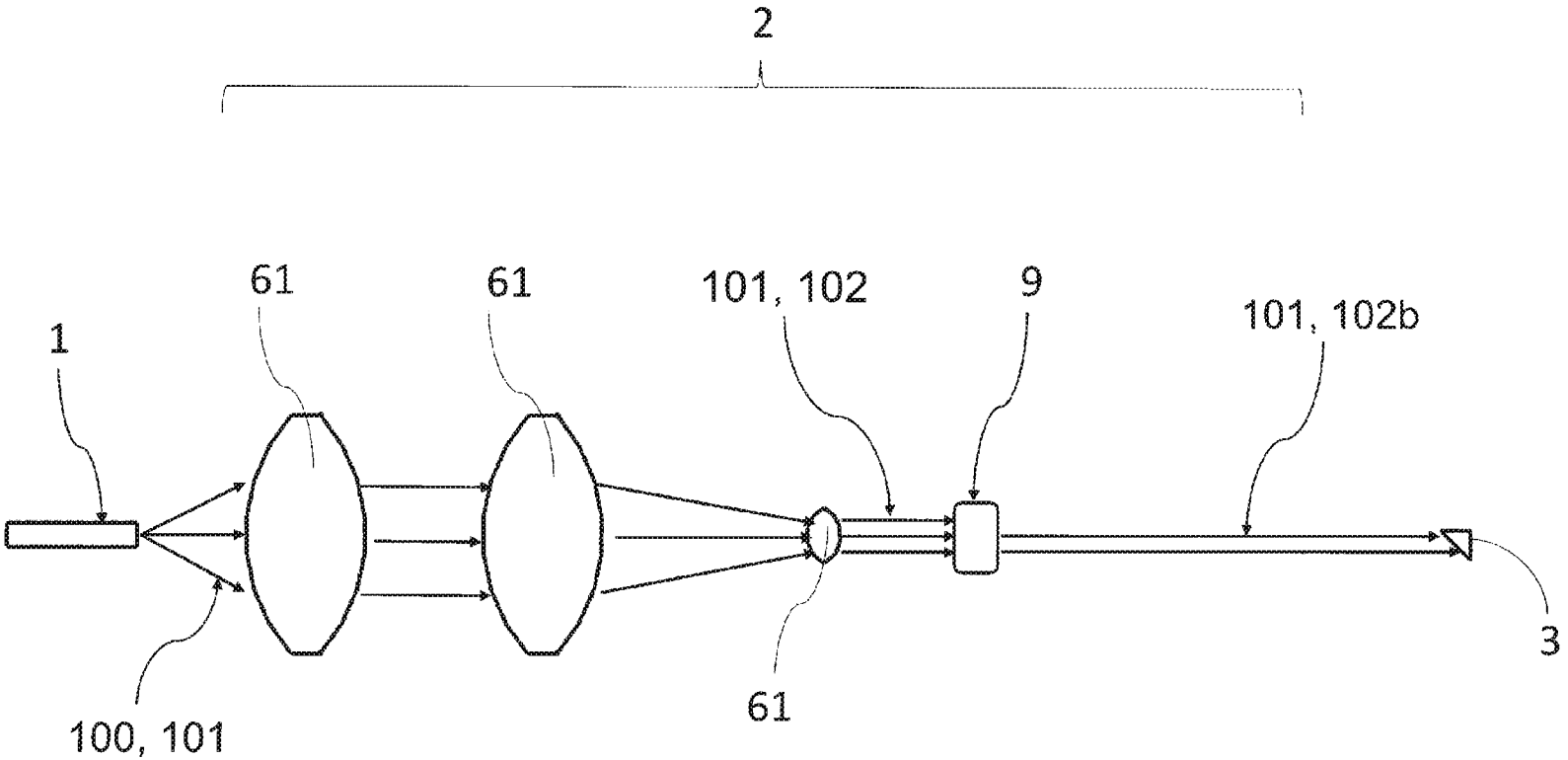

According to FIG. 3*g*, the primary optical system 2 comprises a mechanical modulator 9 of the light beam 102 of coherent light 101 to produce a mechanically modulated light beam 102*b*. The modulation is accomplished e.g. by mechanical screening of a part of the input light beam 102, e.g. in the form of a fixed or movable screen or a semipermeable or partly impermeable filter.

Figure 4A:
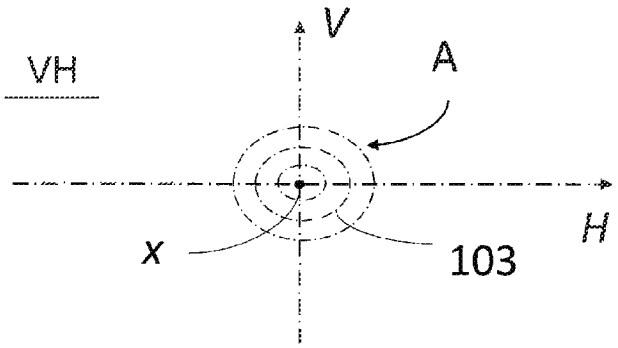
FIG. 4*a* shows an example of the projected light image.
Figure 4B:
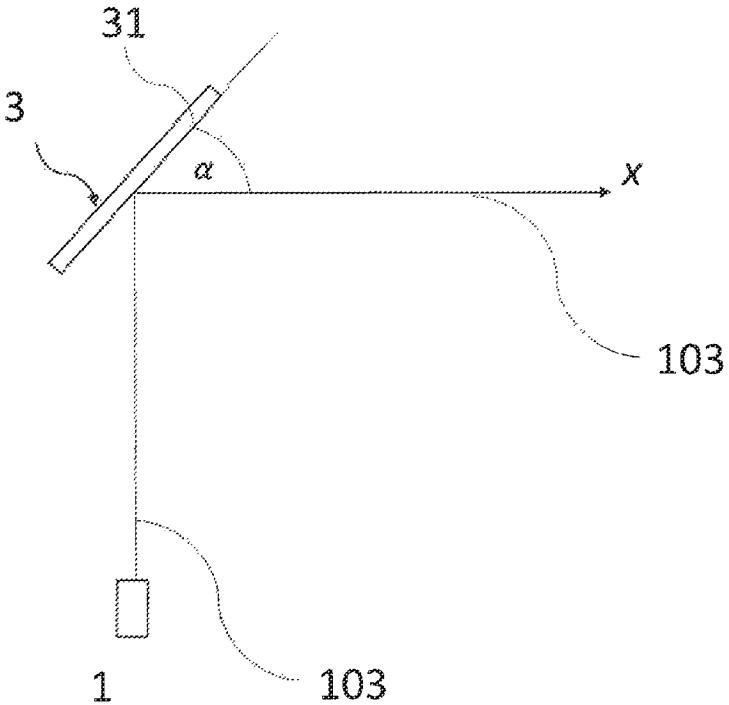
FIG. 4*b* shows a schematic representation of the position of the micro-mirror of FIG. 4*a,*
Figure 4C:
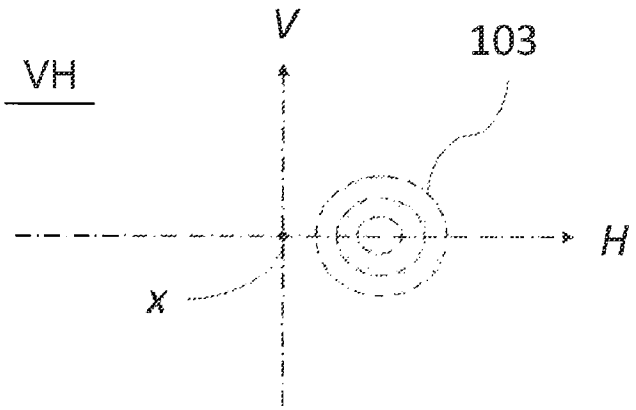
FIG. 4*c* shows another example of the projected light image.
Figure 4D:
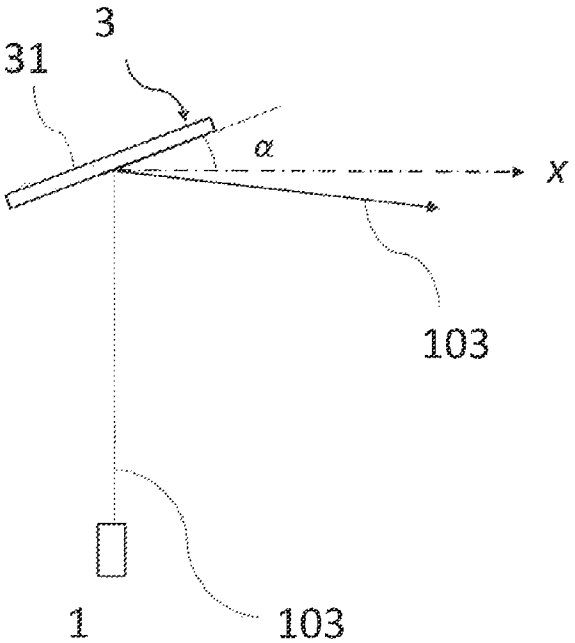
FIG. 4*d* shows a schematic representation of the position of the micro-mirror of FIG. 4*c,*

FIG. 4*a* and FIG. 4*b* show an example of the projected light image and the corresponding micro-mirror 31 wherein the micro-mirror 31 of the MOEMS 3 structure is situated in a static position at the rotation angle $\alpha$ with respect to the optical axis X of light propagation to produce the light pattern A on the display surface VH. The light pattern A created from one light stream 103 contributes to creation of the output characteristic of the light trace in specific zones in front of the driver on the carriageway, where in this example, the center of the light pattern A is situated on the display surface VH on the optical axis x. As indicated in FIGS. 4*c* and 4*d*, a change of the rotation angle $\alpha$ of the micro-mirrors 31 with respect to the optical axis x causes a change of the position of the projected pattern A on the display surface VH so the center of the light pattern produced by the light stream 103 is offset from the direction of the optical axis x on the display surface VH.

As indicated in FIGS. 5*a* to 5*d*, oscillation of the micro-mirror 31 at the oscillation angle $\beta$1, $\beta$2 causes extension/widening of the pattern A. The oscillation angle $\beta$1 determines the extension rate in the direction −H and the oscillation angle $\beta$2 determines the extension rate in the direction +H, i.e. the width d, the height h of the projected pattern A remaining constant. The rotation angles α min and a min then determine the rate of the offset δ of the axes from the optical axis x. The oscillation frequency of the micro-mirror 31 can be constant, or variable and also the angular speed of the free end of the micro-mirror 31 can change on the basis of the current position of the micro-mirror 31 to achieve an even distribution of light in the light pattern A. The instantaneous angular speed can change in such a way as to achieve the required distribution of light.

Figure 6A:
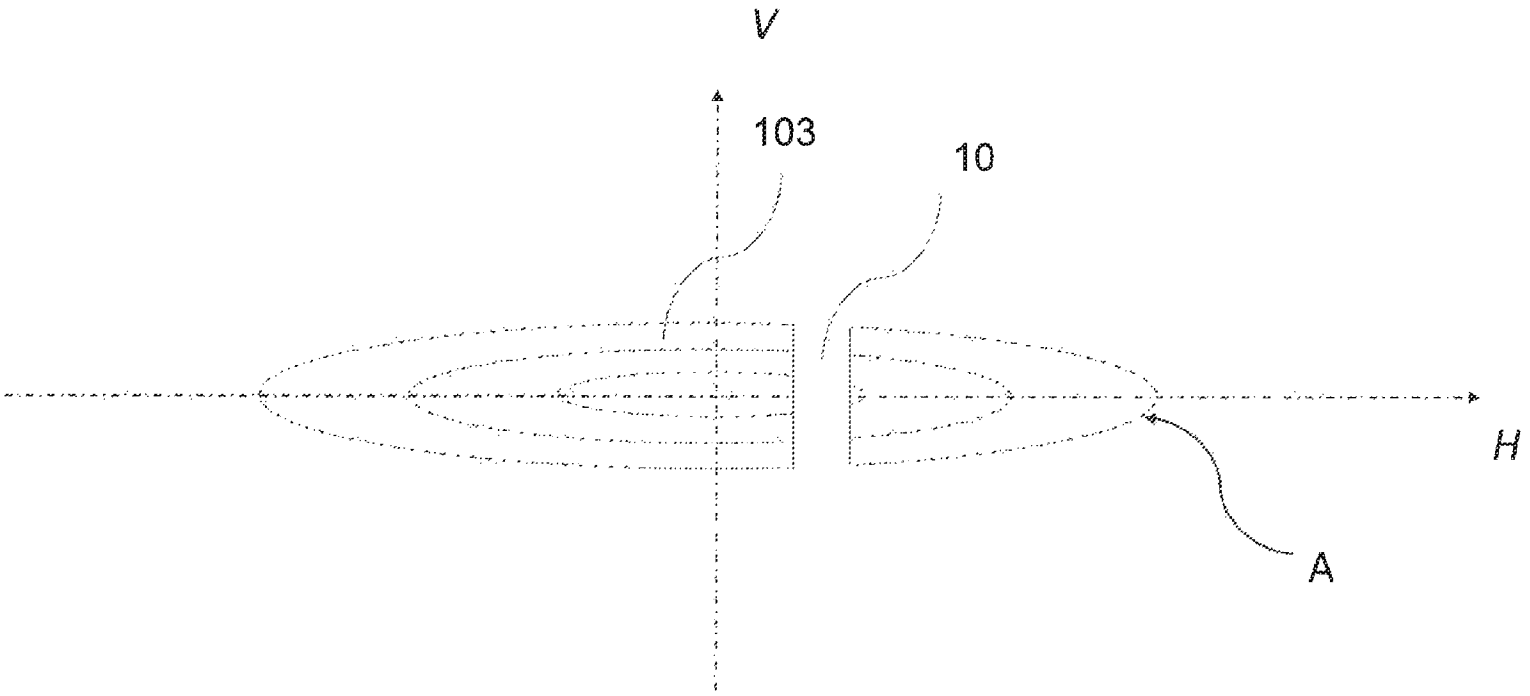
FIG. 6*a* shows another example of the projected light image.
Figure 6B:
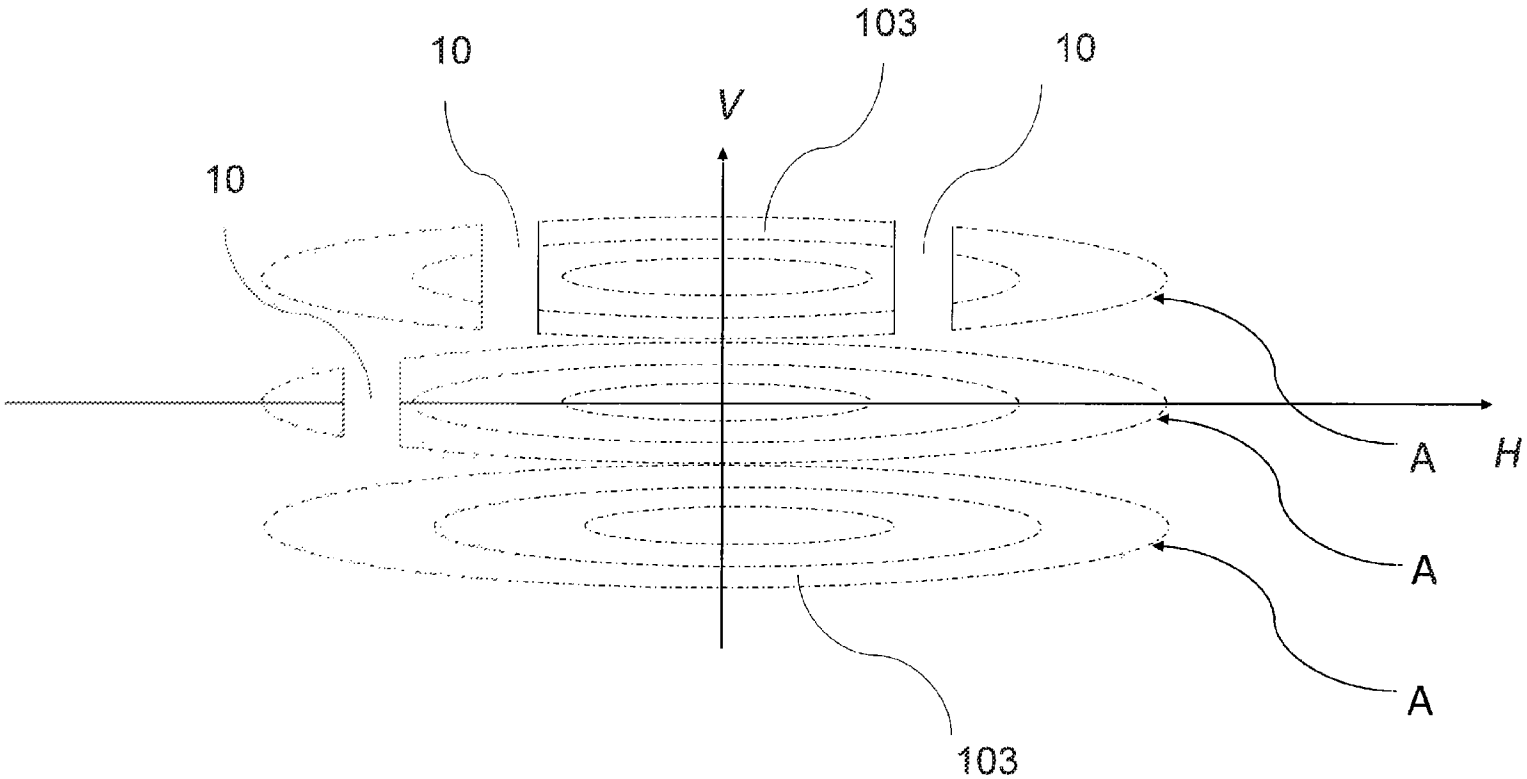
FIG. 6*b* shows another example of the projected light image.

As shown in FIG. 6*a*, an unlit area 10 can be created in the light pattern A by switching off of the light source 1 and/or by means of the modulator 9. FIG. 6*b* shows an output light trace comprising more light patterns A. Each light pattern A consists of one light stream 103 while one or more unlit areas 10 can be produced in each pattern.

Figure 7B:
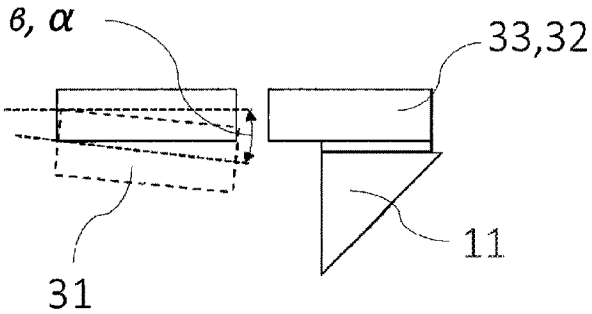
FIG. 7*b* shows a part of the electromagnetically controlled MOEMS in 1D.
Figure 7C:
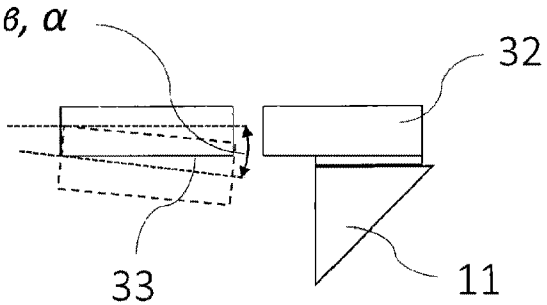
FIG. 7*c* shows a part of the electromagnetically controlled MOEMS in 2D.
Figure 7A:
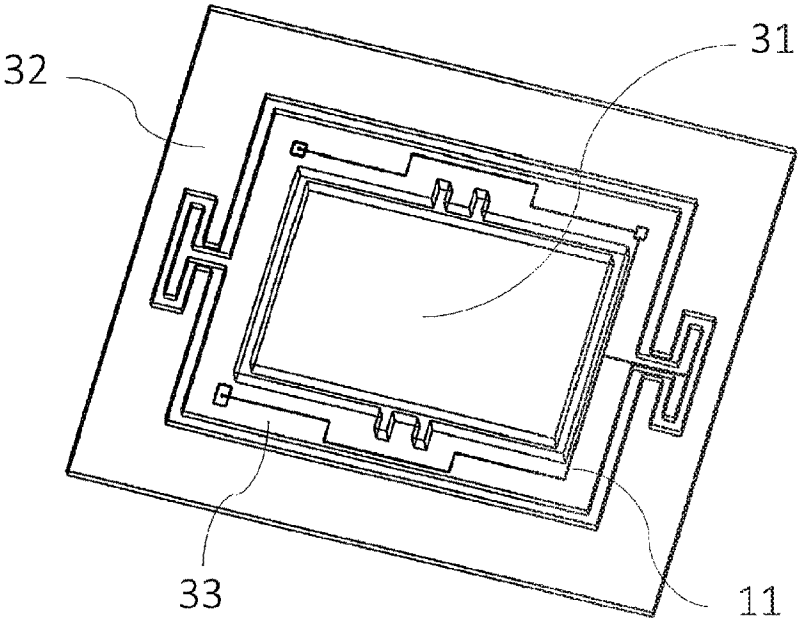
FIG. 7*a* shows an electromagnetically controlled MOEMS in two directions.

FIG. 7*a* shows an example of mounting of the micro-mirror 31, which is part of the MOEMS 3. The micro-mirror 31 is positioned in the first carrying frame 33, which is movable in this example. The first carrying frame 33 is further set in the second carrying frame 32, which is static in this case, the position of the micro-mirror 31 and/or the first carrying frame 33 being influenced by the electromagnetic control system 11. Electric or electromagnetic signals are used to control the rotation angle α and/or the oscillation angle β of the micro-mirror 31 with respect to the first carrying frame 33 or the second carrying frame 32, as indicated in FIG. 7*b*. FIG. 7*c* shows the rotation angle α and/or the oscillation angle β of the movable carrying frame 33 with respect to the static carrying frame 32. This way, it is not only the width d, but also the height h of the light pattern A that can be influenced.

Figure 5A:
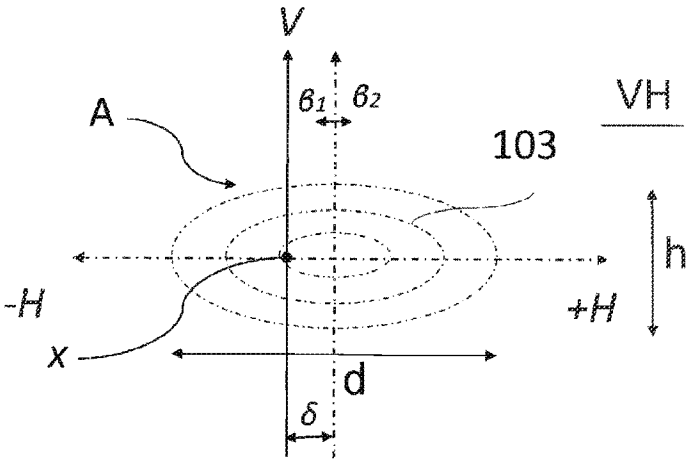
FIG. 5*a* shows another example of the projected light image.
Figure 5B:
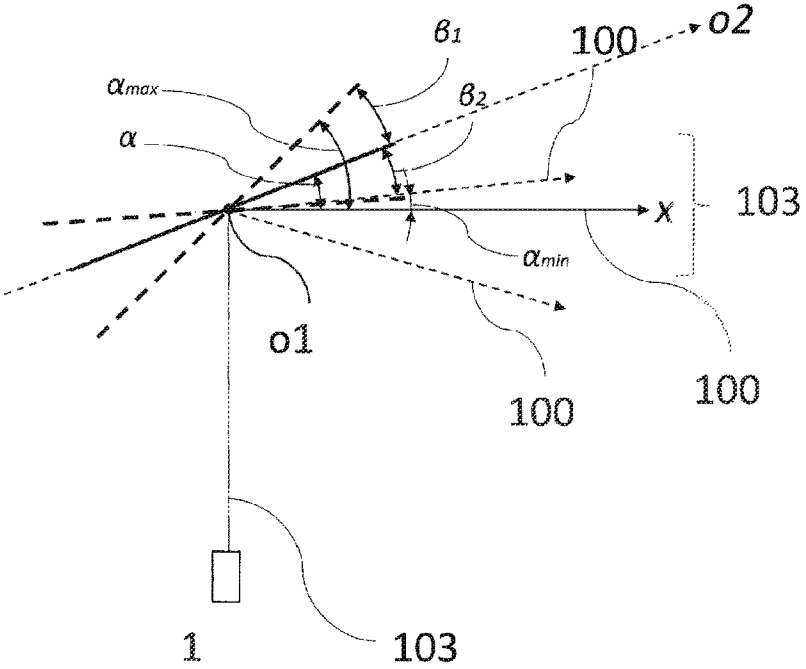
FIG. 5*b* shows a schematic representation of the positions of the micro-mirror of FIG. 5*a,*
Figure 5D:
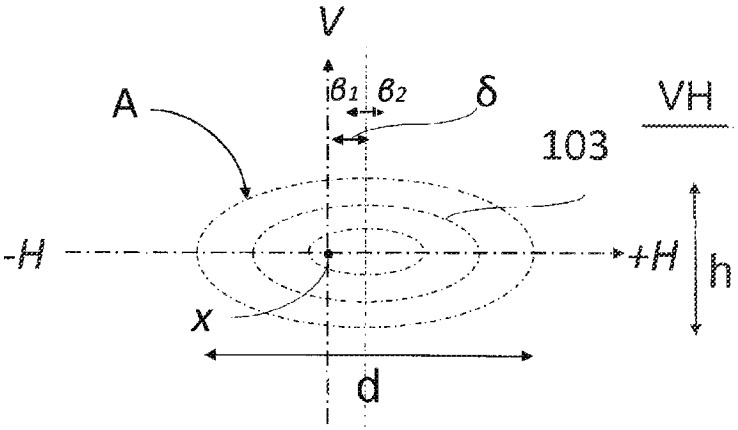
FIG. 5*d* shows a schematic representation of the positions of the micro-mirror of FIG. 5*c,*
Figure 5C:
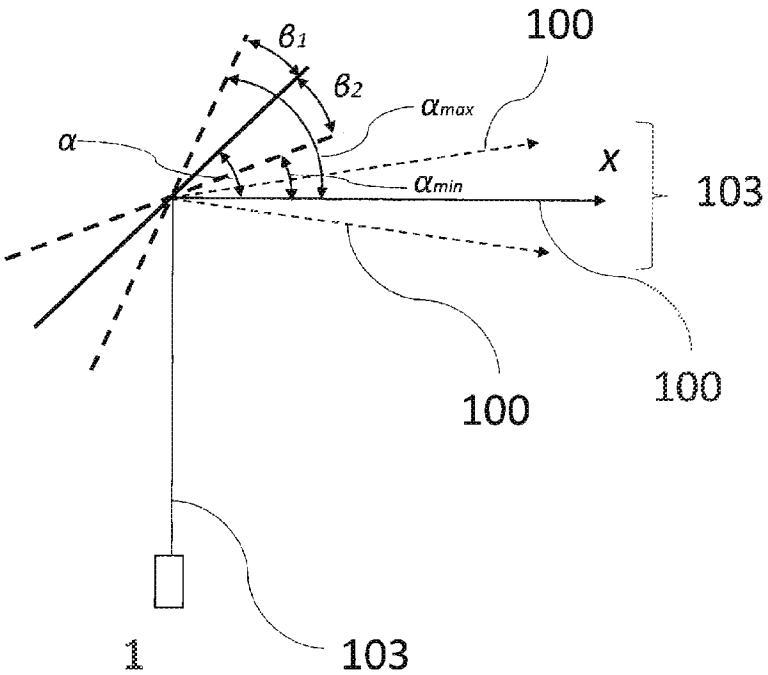
FIG. 5*c* shows another example of the projected light image.

According to FIGS. 5*a* to 5*d*, the micro-mirror 31 is arranged in a movable way for controlled rotation around the first axis o1 (see FIG. 5*b*). In the presented preferred embodiment, the first axis o1 is at the same time the axis around which the micro-mirror 31 can be oscillated in a controlled manner. However, in general, the axis around which the micro-mirror 31 is rotated does not have to be identical with the axis around which the micro-mirror 31 oscillates. In addition, in another embodiment, the micro-mirror can also be rotated around the second axis o2 (see FIG. 5*b*) and it can also be oscillated around the second axis o2. This second axis o2 can be preferably perpendicular to the first axis o1. Rotation and oscillation of the micro-mirror 31 around the second axis o2 provides the possibility to change the shape of the light pattern A and its position—offset in the vertical direction.

MOEMS 3, the light source 1 and the modulator 109 are connected to the electromagnetic control system 11 for transmitting electric or electromagnetic signals to control the current position of the micro-mirror 31 and its movement in accordance with the current conditions where the vehicle finds itself. The light stream 103 exiting from the primary optical system 2 is influenced in such a way to enable changing of the position of the light pattern A on the display surface VH. E.g. if the vehicle is turning, the light pattern A is shifted in the horizontal direction based on the turning direction through changes of the rotation angle α of the micro-mirror 31. The height h and/or width d of the light pattern A changes depending on the vehicle's speed, namely through changes of the oscillation angle β of the micro-mirror 31. Light intensities in individual parts of the light pattern A are changed by influencing the rate and frequency of oscillation of the free end of the micro-mirror 31. When an oncoming vehicle is detected, an unlit area 10 can be created in the light pattern A by means of a not represented light control unit connected to the light source 1 and/or modulator 9 while the light control unit and the electromagnetic control system 11 mutually cooperate.

Figure 8:
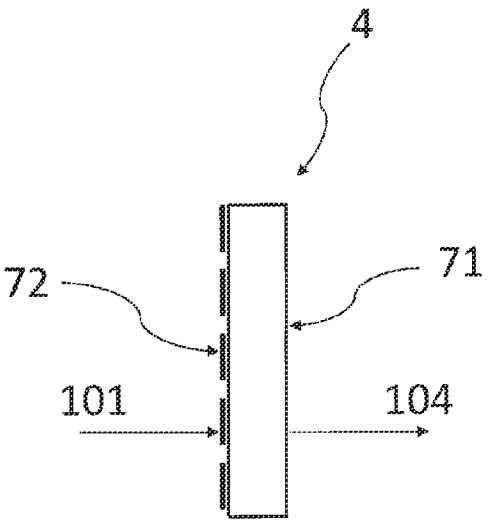
FIG. 8 shows the structure of the converter in the transmission arrangement, used in the light device in accordance with the invention.

FIG. 8 shows the structure of the converter in the transmission arrangement, used in the light device in accordance with the invention. The converter 4 comprises a self-contained converter layer 71 and a filter 72 that are in mutual direct contact.

For the purposes of this invention, the term "self-contained" in the phrase "self-contained converter layer 71" expresses that the converter layer 71 is so firm that it does not need any carrying layer it would be connected to or supported by.

In the transmission as well as reflective arrangement (FIG. 9), the self-contained converter layer 71 can comprise a monocrystal or ceramic body, especially containing Cr:YAG.

As shown in FIG. 8, the filter 72 is located in such a way that coherent light 101 that has been directed by one or more micro-mirrors 31 enters the converter 4 through it. FIG. 8 indicates that it is the transmission arrangement unlike the reflective arrangement, which is shown in the following FIG. 9.

Figure 9:
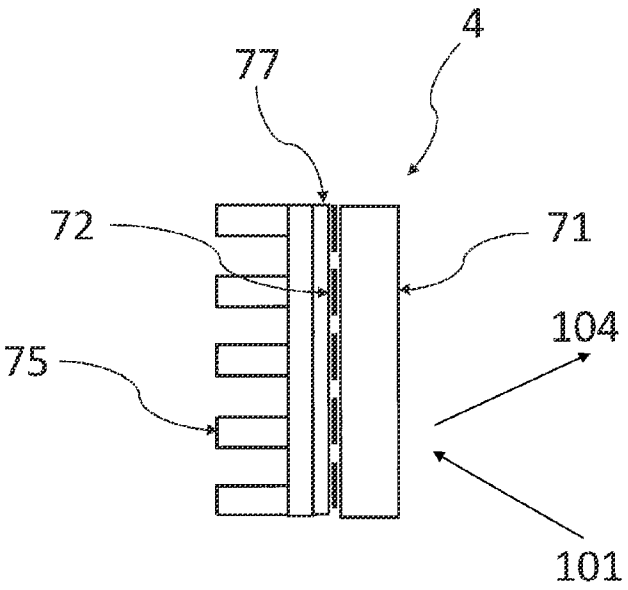
FIG. 9 shows the structure of the converter in the reflective arrangement, used in the light device in accordance with the invention.

FIG. 9 shows the structure of the converter 4 in the reflective arrangement, used in the light device in accordance with the invention. In this structure, the filter 72 is situated between the cooler 75 and the self-contained converter layer 71, situated in such a way that coherent light 101 that has been directed by one or more micro-mirrors 31 enters the converter 4 through it. The filter 72 is connected to the cooler 75 by means of a bonding material 77, especially by melting.

In the above mentioned transmission as well as reflective arrangement, the filter 72 can be e.g.: a spectral filter or a polarizing filter, or an optical layer that reflects a certain part of the spectrum and transmits another part or possibly absorbs some parts of the spectrum, an optical layer configured to transmit blue light from the side of the source and to reflect yellow light from the side of the converter, or a semi-permeable filter (e.g. partly metal-plated in some places).

Figure 10A:
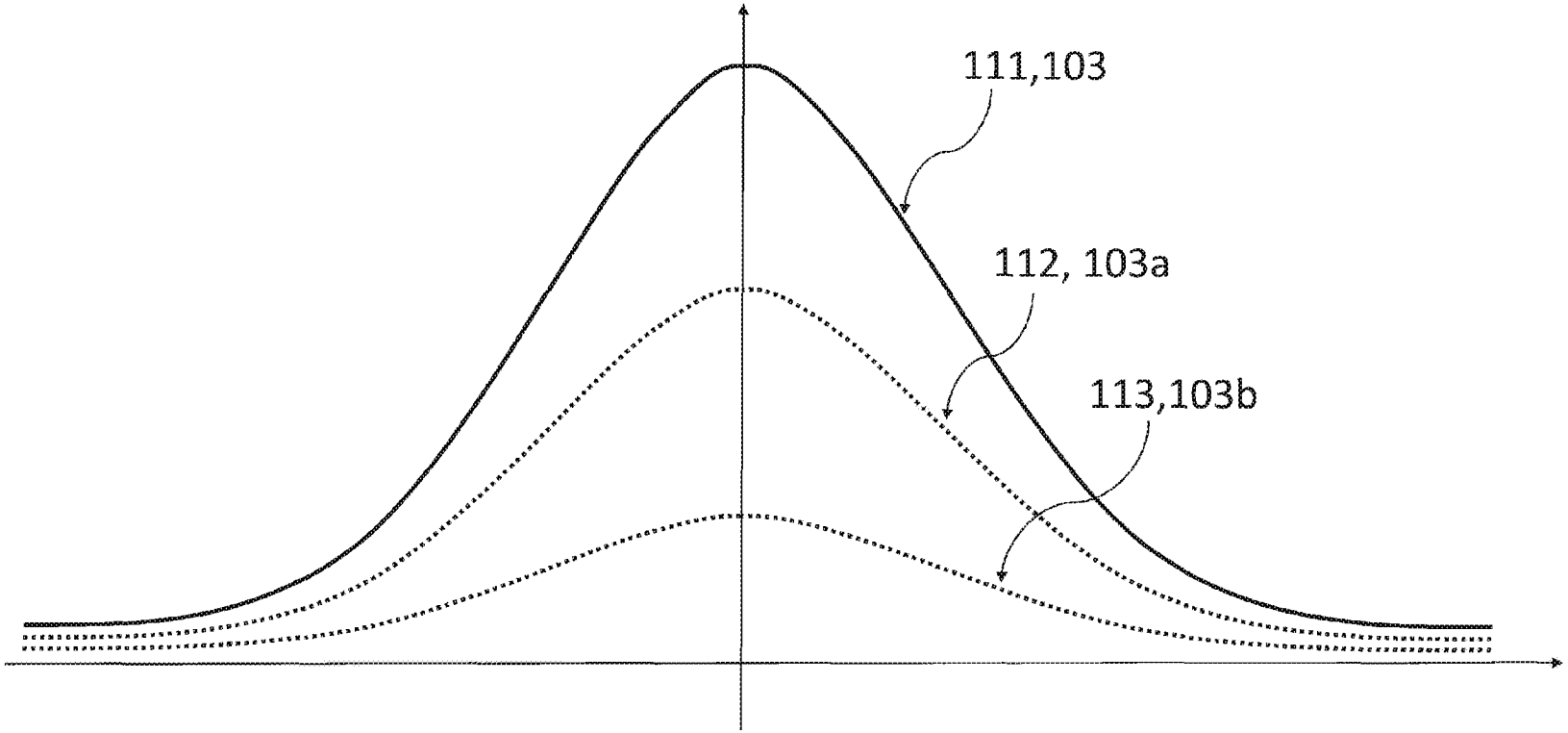
FIG. 10*a* shows shapes of the light stream amplitude.
Figure 10B:
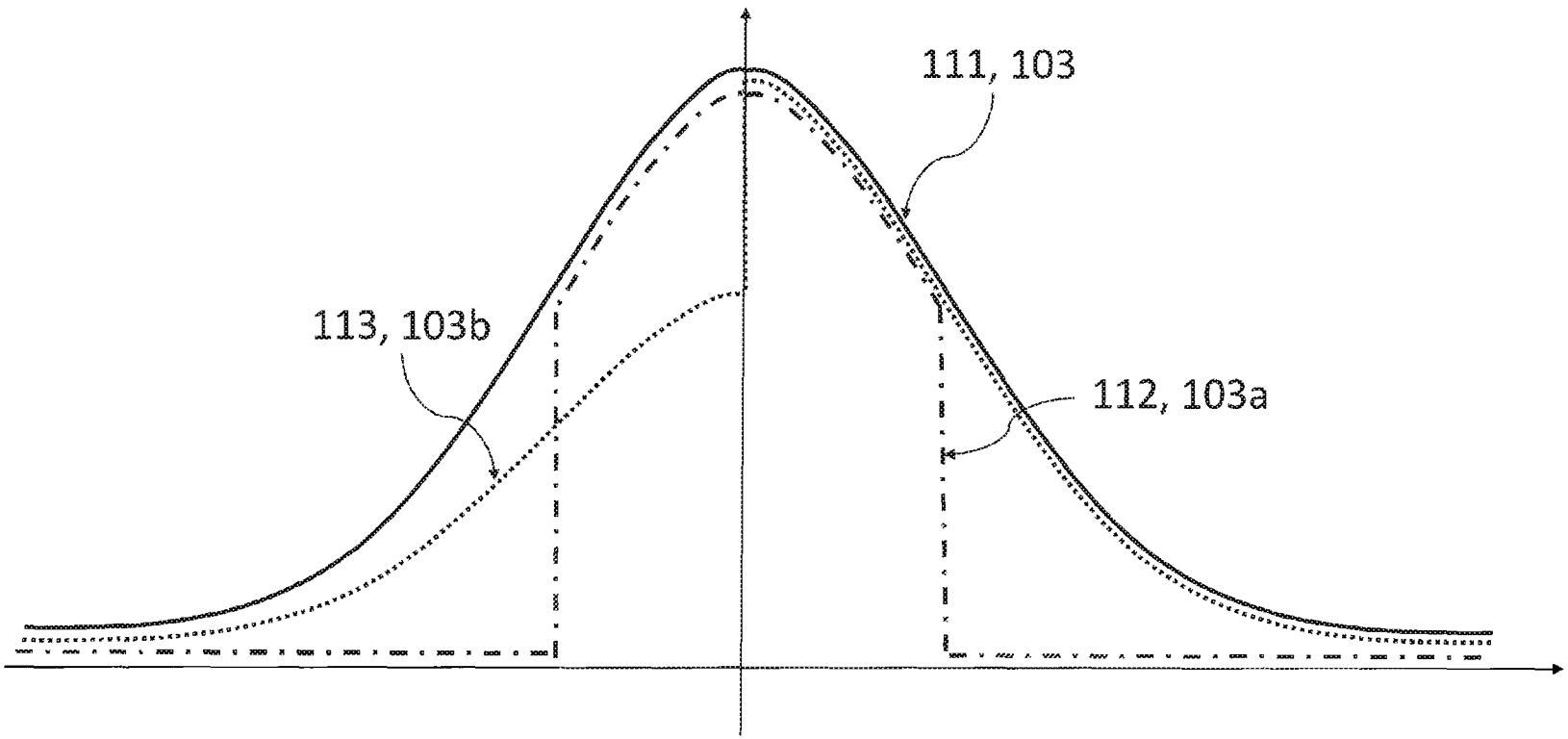
FIG. 10*b* shows more shapes of the light stream amplitude in accordance with the invention.

FIG. 10*a* and FIG. 10*b* show shapes of the amplitude 111 of the input light streams 103 and various shapes of the amplitude 112 of the modulated light streams 102*a* influenced by means of the electro-optical modulator 9, and shapes of the amplitude 113 of the modulated light streams 102*b* influenced by means of the mechanical modulator 9 wherein the amplitude 112 created by means of the electro-optical modulator 9 can be dynamically changed in time and conversely, the amplitude 113 created by means of the mechanical modulator 9 can be changed by spatial positioning (position) of the mechanical modulator 9.

LIST OF REFERENCE MARKS

1 light source
2 primary optical system
3 MOEMS
4 converter
5 secondary optical system
6 diffractive optical element
7 reflective optical element
8 divider
9 modulator
10 unlit area
11 electromagnetic control system
31 micro-mirror

32 second carrying frame
33 first carrying frame
61 lens
62 prism
71 converter layer
72 filter
75 cooler
77 bonding material
100 light ray
101 coherent light
102 collimated light beam
102*a* electro-optically modulated light beam
102*b* mechanically modulated light beam
103 light stream
104 white light
111 amplitude shape
112 modulated amplitude shape
113 modulated amplitude shape
O1 first axis
O2 second axis
H horizontal plane
V vertical plane
VH display surface
X optical axis of the lamp
α rotation angle
α min minimum rotation angle
α max maximum rotation angle
β oscillation angle
β1 oscillation angle
β2 oscillation angle
A light pattern
d pattern width
h pattern height
δ offset rate

The invention claimed is:

1. A light device, especially the projector system of a headlight for motor vehicles comprising a laser light source, a primary optical system with at least one diffractive optical element or with at least one reflective optical element to convert the monochromatic coherent light produced by the laser light source to a collimated beam of coherent light, a MOEMS comprising one or more micro-mirrors to route coherent light to a converter to convert the coherent light to white light, and a secondary optical system comprising at least one diffractive optical element or at least one reflective optical element to direct the white light further out of the light device and to create a light pattern on the display surface or in specific zones in front of the driver on a roadway, wherein the light device comprises a modulator situated between the laser light source and the secondary optical system along the route of a beam of light rays produced by the laser light source and advancing from this source to the secondary optical system, to influence the light characteristic of at least part of the beam, the light source further comprising an electromagnetic control system connected to the MOEMS and to the laser light source to control, through transmission of electric or electromagnetic signals, changes of the rotation angle, changes of the oscillation angle and changes of the oscillation rate and frequency of the free end of at least one of the micro-mirrors, and to control the activity of the laser light source, for controlled changing of the shape and/or position of the light pattern depending on current conditions where the vehicle finds itself during the vehicle's operation.

2. The light device in accordance with claim 1, wherein the light device comprises just one laser light source.

3. The light device in accordance with claim 1, wherein the electromagnetic control system is connectable to an output of one or more information means in the form of signals which data collected by information means about the current conditions where the vehicle finds itself during the vehicle's operation have been transformed into.

4. The light device in accordance with claim 1, wherein the modulator is situated between the laser light source and the primary optical system to influence the light characteristic of at least part of the laser beam of coherent light.

5. The light device in accordance with claim 1, wherein the modulator is situated between the primary optical system and the secondary optical system to influence the light characteristic of at least part of the collimated light beam.

6. The light device in accordance with claim 1, wherein the primary optical system further comprises a divider to divide the collimated beam into more separate light streams.

7. The light device in accordance with claim 6, wherein the primary optical system comprises a modulator of the light stream.

8. The light device in accordance with claim 1, wherein the modulator is configured to interrupt or deflect at least a part of a beam of light rays, especially a light stream, to produce one or more unlit areas in the light pattern.

9. The light device in accordance with claim 1, wherein the modulator is connected to an electromagnetic control system that controls the operation of the modulator, especially with respect to the current conditions where the vehicle finds itself during the vehicle's operation.

10. The light device in accordance claim 1, wherein the said at least one of the micro-mirrors is arranged in a movable manner in such a way that at least one of the micro-mirrors can be rotated in a controlled manner around a first axis, which is identical with the axis around which the micro-mirror can be oscillated in a controlled way.

11. The light device in accordance with claim 10, wherein the said at least one of the micro-mirrors is arranged in a movable manner in such a way that it can also be rotated in a controlled manner around a second axis around which the micro-mirror can also be oscillated in a controlled way.

12. The light device in accordance with claim 11, wherein the second axis lies on a horizontal plane and is perpendicular to the first axis.

13. The light device in accordance with claim 11, wherein the said at least one of the micro-mirrors is mounted in a movable first carrying frame with the possibility of controlled rotation and oscillation of the micro-mirror in this first frame around the said first axis, this first frame being arranged in such a way that the first frame can be rotated and oscillated around the said second axis in a controlled way.

14. The light device in accordance with claim 13, wherein the first carrying frame is mounted in a movable way in a static second carrying frame.

15. The light device in accordance with claim 1, wherein information means are the means used to establish the instantaneous angle, turning direction of the vehicle, its instantaneous speed, or to detect an oncoming vehicle.

16. The light device in accordance with claim 1, wherein the converter comprises a self-contained converter layer and a filter that are in a mutual direct contact.

17. The light device in accordance with claim 16, wherein the self-contained converter layer consists of a monocrystal or ceramic body, especially containing Cr:YAG.

18. The light device in accordance with claim 16, wherein the filter is located in such a way that coherent light that has been directed by one or more micro-mirrors enters the converter through the filter.

19. The light device in accordance with claim 16, wherein the filter is located between a cooler and the self-contained converter layer situated in such a way that coherent light that has been directed by one or more micro-mirrors enters the converter through the self-contained converter layer.

20. The light device in accordance with claim 19, wherein the filter is connected to the cooler by means of a bonding material, especially by melting.

* * * * *